United States Patent [19]

Morimoto et al.

[11] Patent Number: 4,521,153

[45] Date of Patent: Jun. 4, 1985

[54] BLOWER AND ROTATING WIND DEFLECTOR

[75] Inventors: Masao Morimoto; Shoji Sano; Kazuyoshi Yoshimi; Kazuo Saitou, all of Kasai, Japan

[73] Assignee: Sanyo Electric Co., Ltd., Japan

[21] Appl. No.: 426,203

[22] Filed: Sep. 28, 1982

[30] Foreign Application Priority Data

Feb. 17, 1982 [JP] Japan ..... 57-25126

[51] Int. Cl.[3] ..... F01B 25/02

[52] U.S. Cl. ..... 415/146; 415/62; 415/143; 415/150; 98/40.26; 98/121.2

[58] Field of Search ..... 415/125, 121 G, 14.6, 415/62, 63, 81, 150; 98/40 V; 416/247 R

[56] References Cited

U.S. PATENT DOCUMENTS

| | | | |
|---|---|---|---|
| 2,134,649 | 10/1938 | Will et al. | 98/40 V |
| 3,397,836 | 8/1968 | Badger et al. | 415/150 X |
| 3,481,534 | 12/1969 | Price | 415/146 |
| 3,779,665 | 12/1973 | Tatem, Jr. et al. | 415/150 X |
| 4,007,673 | 2/1977 | Zaloga | 98/40 V |
| 4,084,491 | 4/1978 | Spotts et al. | 415/125 |
| 4,350,472 | 9/1982 | Morimoto | 415/150 X |

*Primary Examiner*—William E. Wayner
*Assistant Examiner*—John Sollecito
*Attorney, Agent, or Firm*—Darby & Darby

[57] ABSTRACT

Herein disclosed is a blower which comprises a fan, means for driving said fan, a body housing or guard mounting said fan therein, a wind deflector mounted in the front opening of said body so that it can rotate in said front opening, and a rear guard mounted in the rear opening of said body. Said wind deflector is formed with changing vanes which are made receptive of the air wind generated by said fan for imparting a rotational force to said wind deflector. Moreover, the changing vanes are made at least partially so movable that they can be adjusted to have an arbitrary vane angle for changing a rotating speed on a rotating direction of said wind deflector.

16 Claims, 40 Drawing Figures

BLOWER AND ROTATING WIND DEFLECTOR

BACKGROUND OF THE INVENTION

1. Field of the Invention

The present invention relates to a blower which is equipped with such a wind deflector as is rotated by the wind pressure of an air flow generated by a fan.

2. Description of the Prior Art

As a blower which is equipped with such a wind deflector as is rotated by a forced swirling air flow generated by a fan, especially, by an axial flow fan, there are disclosed in the prior art in Japanese Utility Model Publication No. 35-8954, Japanese Utility Model Laid-Open Publication No. 55-46796, U.S. Pat. No. 2,824,429, U.S. Pat. No. 3,481,534 and U.S. Pat. No. 2,134,649. In the above-identified prior art examples, there is disclosed only a blower which is equipped merely with such a wind deflector as is rotated by the wind pressure of an air flow. Moreover, since the aforementioned wind deflector is accelerated by the aforementioned wind pressure of the air flow so that it is rotated at a high speed, there exists either a blower making use of a frictional force, as in Japanese Utility Model Publication No. 35-8954, or a blower making use of a gear governor, as in Japanese Utility Model Laid-Open Publication No. 55-46796, so that the wind deflector may be rotated at a substantially constant low speed. However, either of them requires a complex mechanism. In the blower making use of the frictional force, as in the Japanese Utility Model Publication No. 35-8954, moreover, the rotating speed of the aforementioned wind deflector can be changed by suitably changing the frictional force. However, this blower is short of reliability for a long use because it makes use of the frictional force.

SUMMARY OF THE INVENTION

The present invention has been conceived in view of the points thus far described and has an object to provide a blower which is enabled to suitably use a wind deflector at such a rotating speed as is suitable for the taste of the user.

According to one feature of the present invention, there is provided a blower comprising: a fan; means for driving said fan; a body housing or guard mounting said fan therein; a wind deflector mounted in the front opening of said body so that it can freely rotate in said front opening; and a rear guard mounted in the rear opening of said body; in that said wind deflector is composed of changing vanes made receptive of the air wind, which is generated by said fan, for imparting a rotational force to said wind deflector; and in that said changing vanes are at least partially made so movable that they can be adjusted to have an arbitrary vane angle.

According to the present invention, specifically, since a number of wind deflecting vanes constructing a wind deflector are at least partially made movable, the force to be imparted to said wind deflecting vanes for contributing to the rotations is so changed by the forced air flow generated by the fan that the rotating speed of said wind deflector may be changed, whereby a gentle, comfortable wind can be supplied at a desired rotating speed over a wide angular range.

BRIEF DESCRIPTION OF THE DRAWINGS

FIG. 5 is a perspective view;

FIG. 6 is a sectional view;

FIG. 7 is a front elevation;

FIG. 8 a front elevation showing the portion of a stopper mechanism;

FIG. 9 is a sectional front elevation showing the portion of the stopper mechanism;

FIG. 10 is a section taken along line X—X of FIG. 9;

FIG. 11 is a sectional front elevation showing the portion of the stopper mechanism in a state in which it is in engagement with a wind deflector;

FIG. 12 is a sectional view showing the portion of the stopper mechanism when the wind deflector is to be attached;

FIG. 13 is a rear view showing the wind deflector;

FIG. 14 is an exploded perspective view showing the same;

FIG. 15 is an exploded perspective view showing an essential portion in section;

FIG. 16 is a view showing the mechanism of the wind deflector;

FIG. 17 is a section taken along line XVII—XVII of FIG. 16(*b*);

FIG. 18 is a section taken along line XVIII—XVIII of FIG. 16(*b*);

FIGS. 19 to 21 are sectional views showing the rotating states of the wind deflector;

FIG. 22 is a section taken along line XXII—XXII of FIG. 19;

FIG. 23 is a transverse section showing an essential portion with its portion being omitted; and FIGS. 24 and 25 are perspective views showing the different operational states of the wind deflector.

FIG. 26 is a front elevation;

FIG. 27 is a sectional view showing the portion of a wind deflector; and

FIGS. 28 and 29 are perspective views showing the different operational states.

FIG. 30 is a perspective view;

FIG. 31 is a sectional view;

FIG. 32 is a front elevation;

FIG. 33 is a rear view showing the wind deflector;

FIG. 34 is an exploded perspective view showing the same;

FIG. 35 is an exploded perspective view showing an essential portion in section;

FIG. 36 is a transverse section showing an essential portion with its portion being omitted; and FIGS. 37 and 38 are perspective views showing the different operational states.

DESCRIPTION OF THE PREFERRED EMBODIMENTS

The present invention will be described in the following with reference to FIGS. 1 to 25 showing a such a box-shaped blower, which uses an axial flow fan as a fan for generating a forced air flow and which can be easily carried place to place for use, as has a generally square front and a small depth.

First of all, both the relationship in force between the swirling air flow generated by an axial flow fan and a multiplicity of wind deflecting vanes constructing a wind deflector and the rotating principle of the wind deflector will be described with reference to FIGS. 1 to 4.

Figure 1:
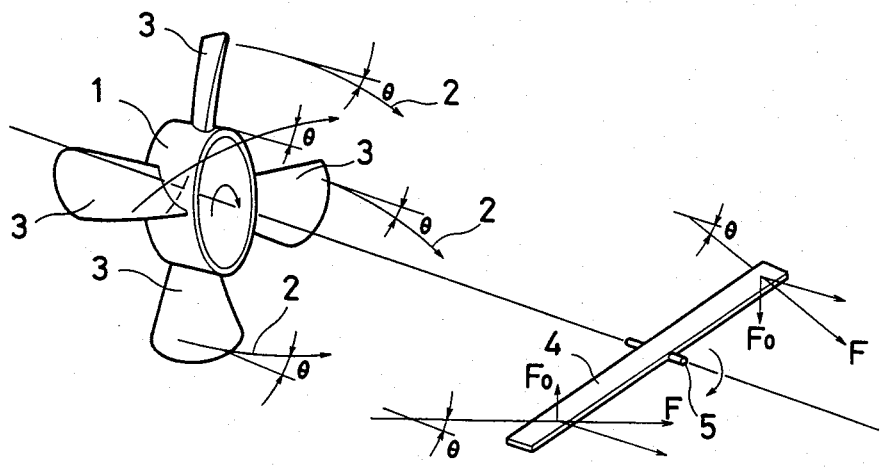
FIG. 1 is a perspective view illustrating the relationship between an axial flow fan and wind deflecting vanes.
Figure 2:
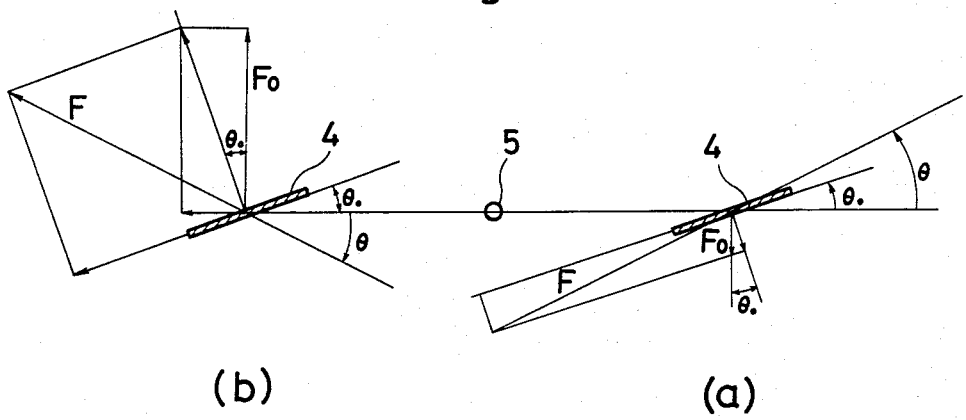
FIG. 2 is a view illustrating the general relationship in force between an air flow and a wind deflecting vane.
Figure 3:
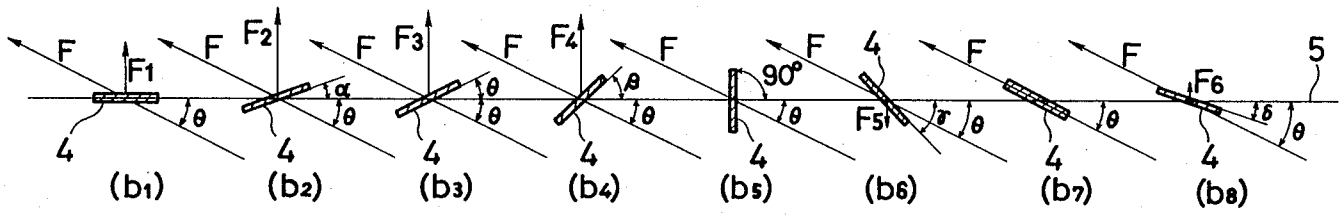
FIG. 3 is a view illustrating the relationships in force between the angles of inclination of the wind deflecting vanes, which are located at the lefthand side of a pivot, and the air flow.
Figure 4:
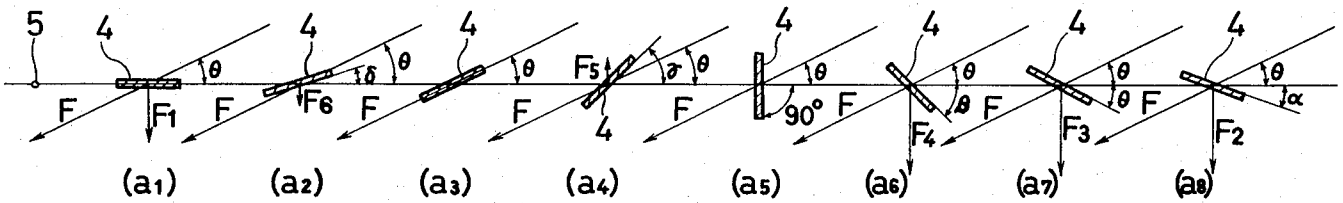
FIG. 4 is a view illustrating the relationships in force between the angles of inclinations of the wind deflecting vanes, which are located at the righthand side of the pivot, and the air flow.
Figure 5:
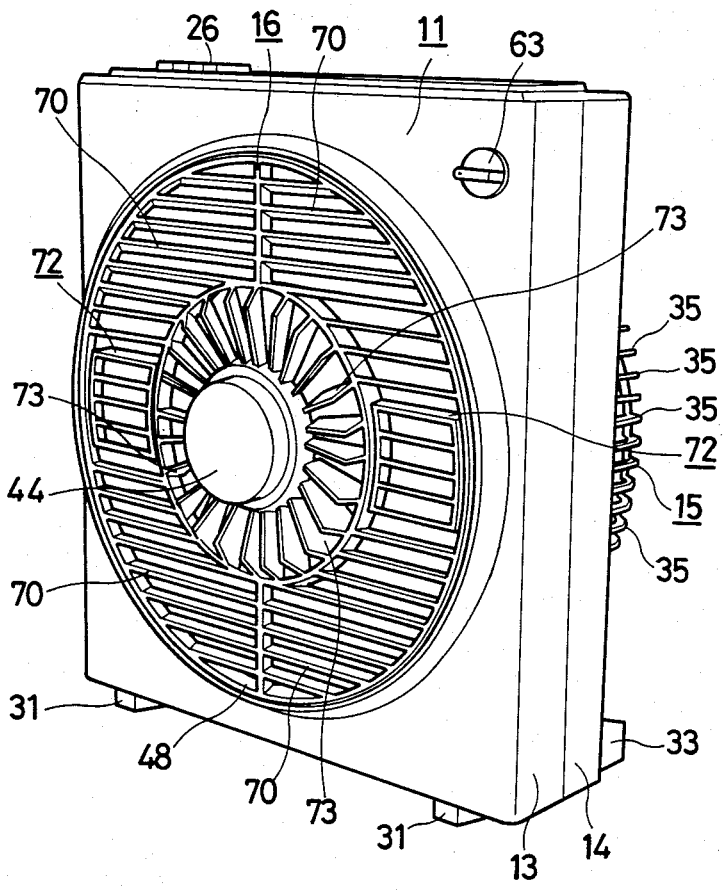
In FIGS. 5 to 25 showing one embodiment of the blower according to the present invention.
Figure 6:
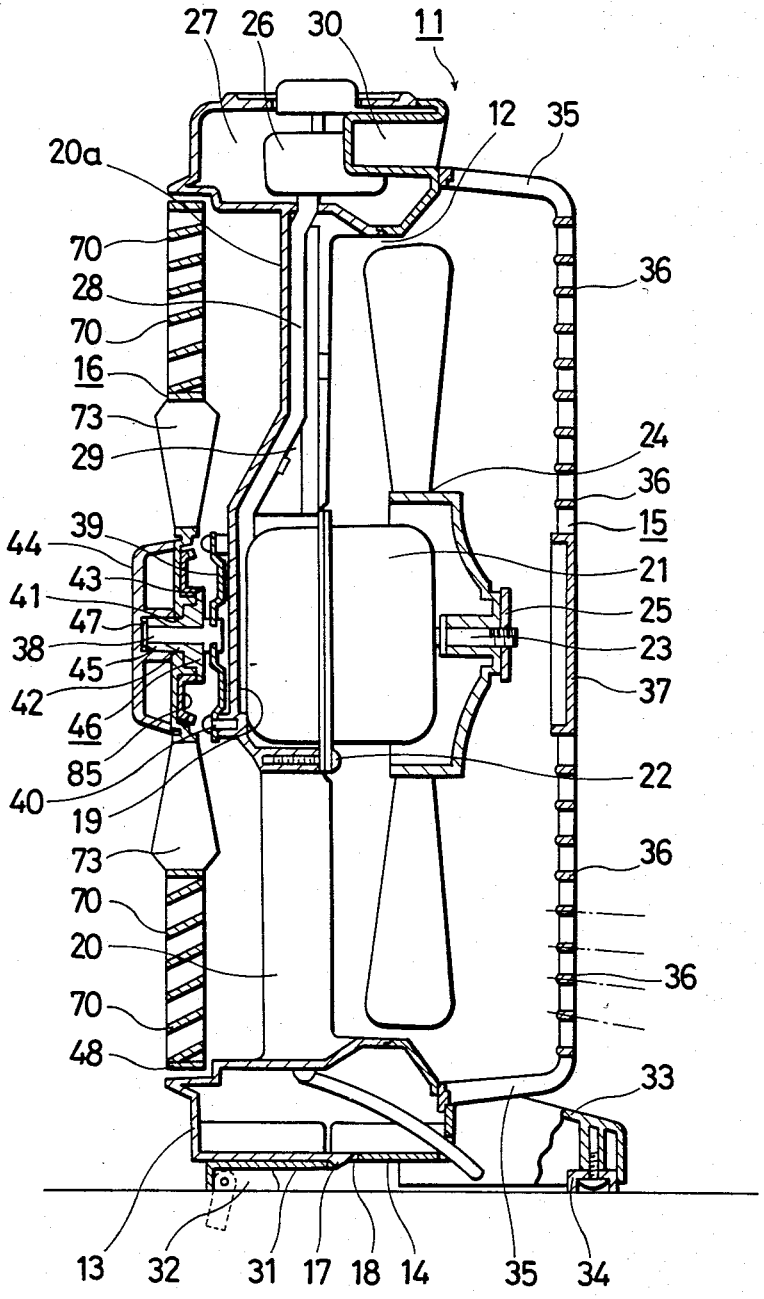
Figure 7:
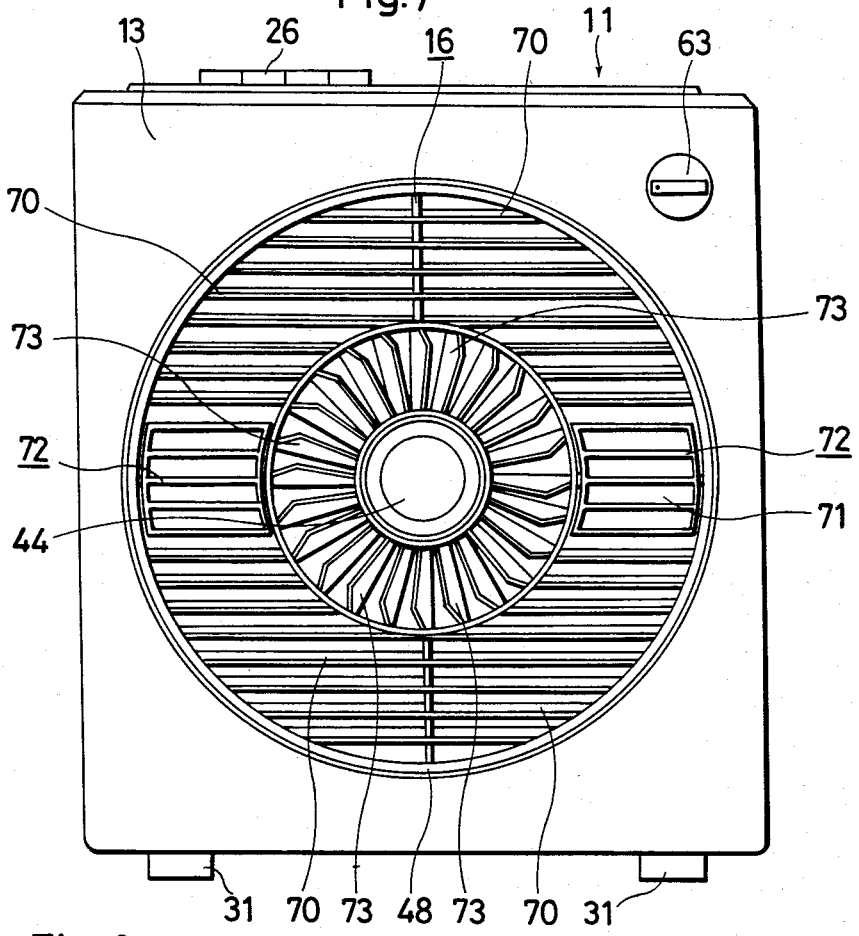
Figure 8:
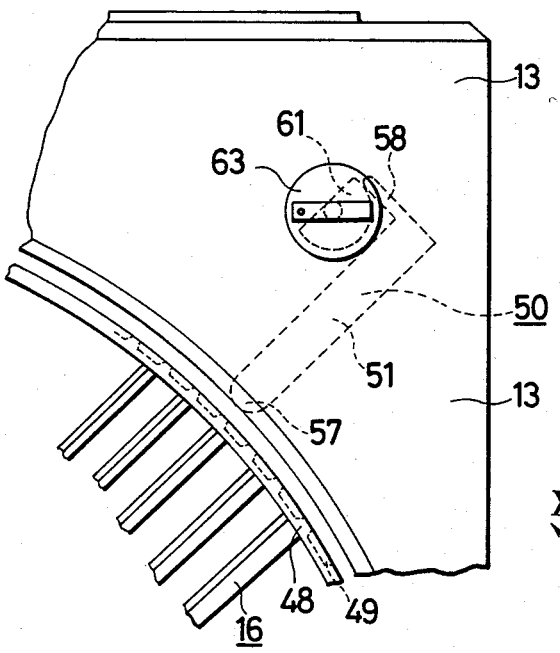
Figure 9:
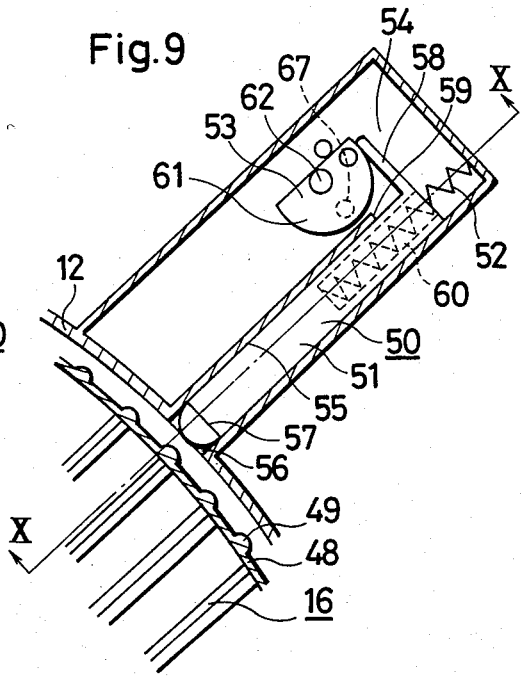
Figure 10:
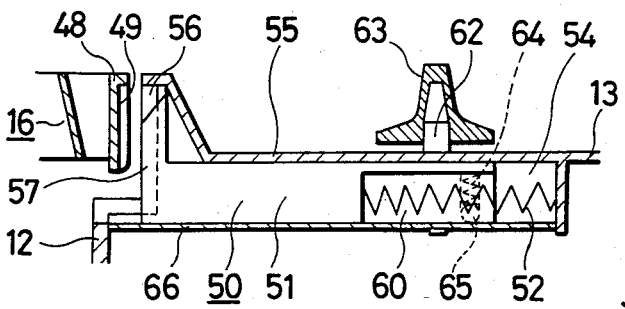
Figure 11:
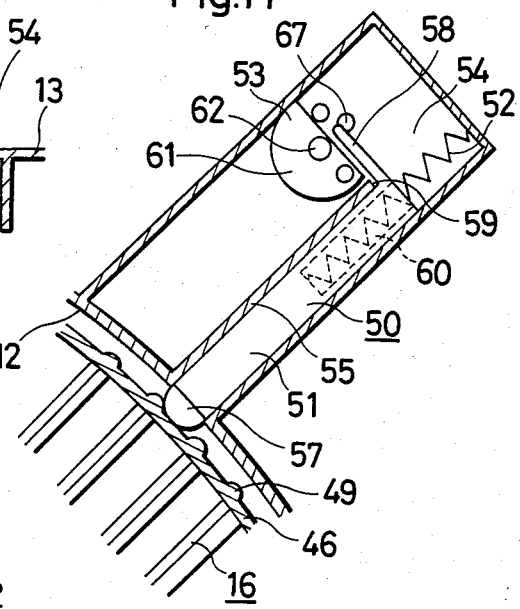
Figure 12:
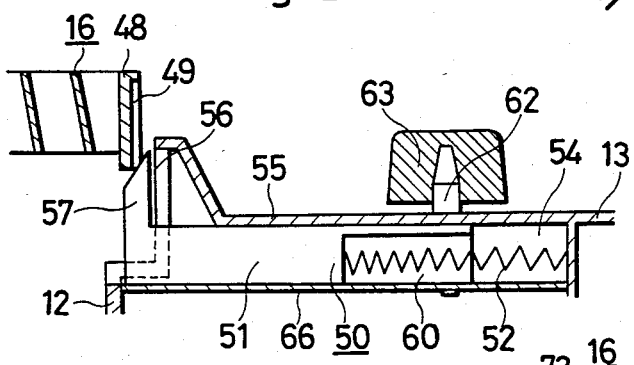
Figure 13:
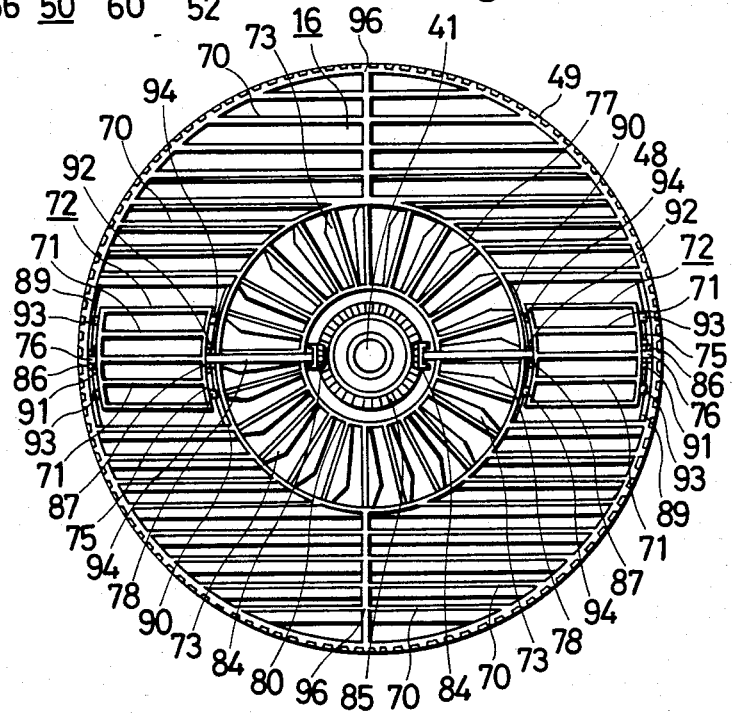
Figure 14:
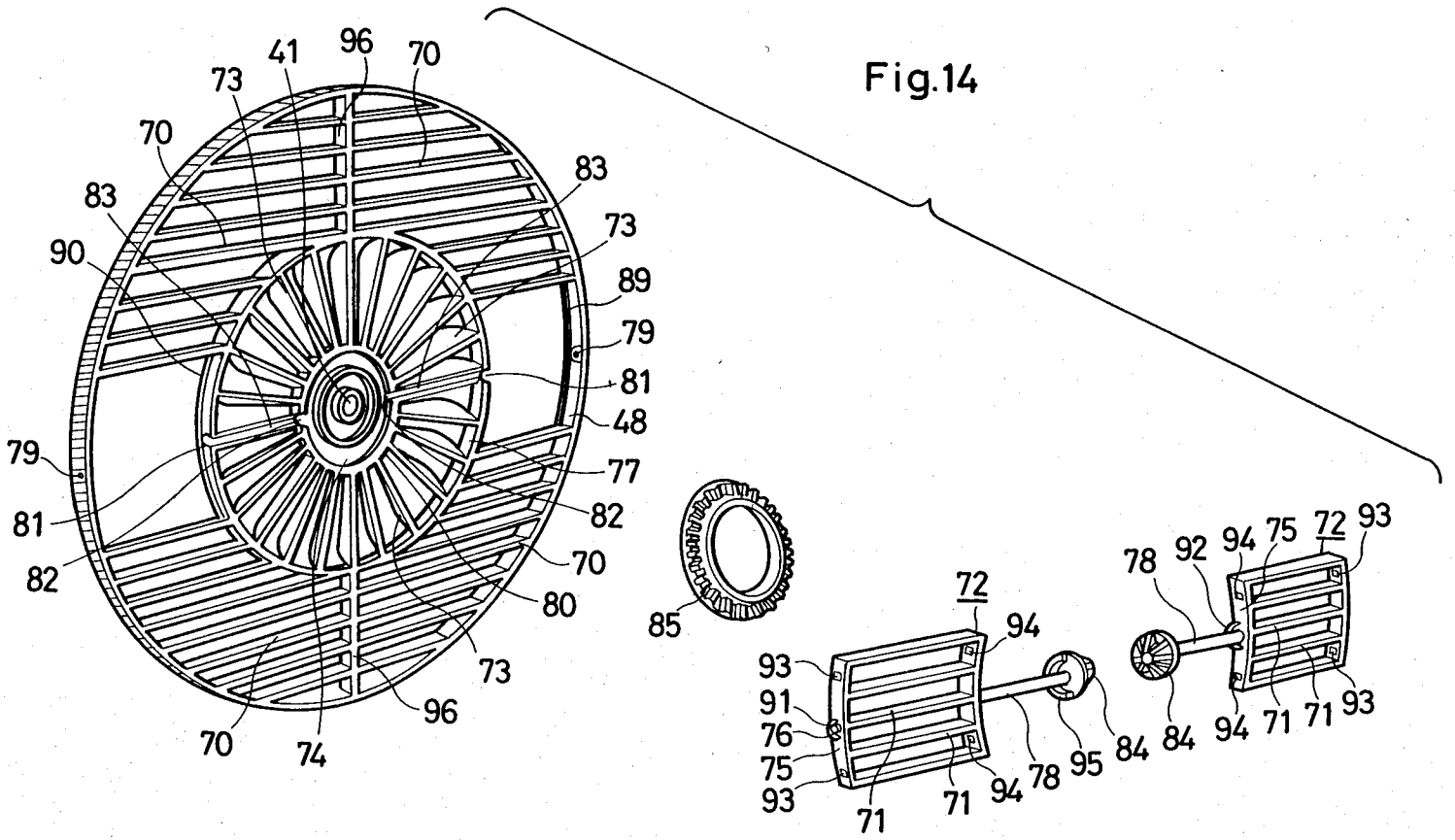
Figure 15:
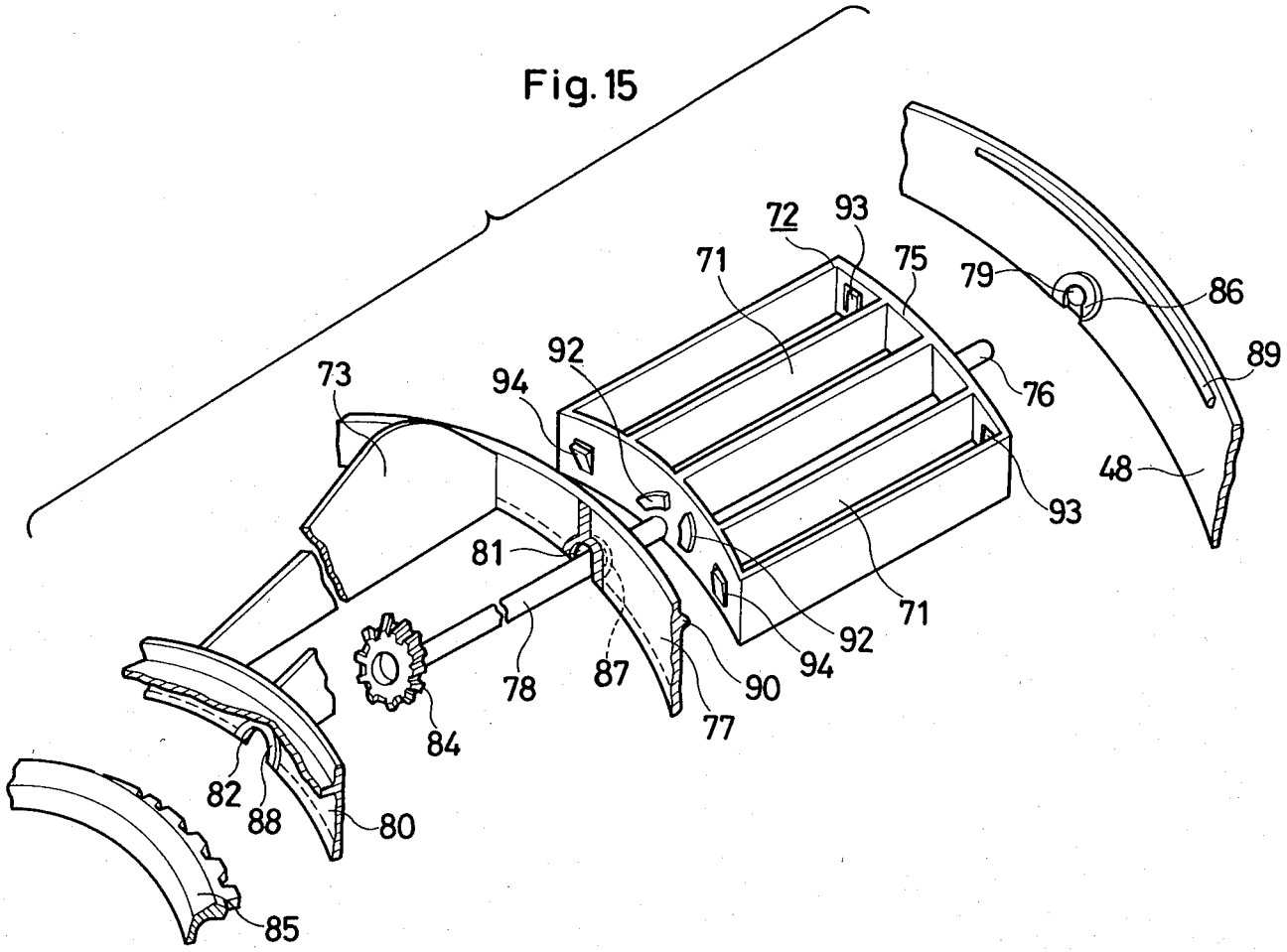

A swirling air flow 2 generated by an axial flow fan 1 is blown in such a direction as is twisted at an angle $\theta$ shown in the drawings as a result that vanes 3 constructing the axial flow fan 1 are twisted to have such a radius of curvature as is predetermined in design. Wind deflecting vanes 4, which are formed in multiplicity in the wind deflector placed in front of the axial flow fan 1, are rotatably borne on a spindle 5 and are formed at such an angle of inclination as is indicated at $\theta_o$ in the drawings. As a result, the force $F_o$, which is exerted upon the righthand and lefthand sides of the wind deflecting vanes 4 for moving the deflecting vanes 4 on the spindle 5 is expressed by $F_o=F\sin(\theta-\theta_o)\cos\theta_o$ in case the force of the air flow 2 is designated at F. Now, if it is assumed that the righthand and lefthand sides have an equal inclination, as shown in FIG 2, and that an inequality of $\theta>\theta_o$ holds, a downward force is exerted at the righthand half whereas an upward force is exerted at the lefthand side. As a result, equal clockwise moments on the spindle 5 are exerted upon the aforementioned deflecting vanes 4 so that these vanes 4 are rotated clockwise by their resultant force. For $\theta=\theta_o$, an equation of $F_o=0$ holds at the righthand half so that the clockwise moment is exerted only upon the lefthand half. For $\theta<\theta_o$, the counter-clockwise moment is exerted upon the righthand side whereas the clockwise moment is exerted upon the lefthand side. As a result, the aforementioned deflecting vanes 4 are rotated in the direction of the stronger moment by the difference between the aforementioned two moments. The relationships of the force $F_o$ for moving the deflecting vanes 4 due to the blown angle $\theta$ of the aforementioned air flow 2 and the angle $\theta_o$ of inclination of the deflecting vanes 4 will be further described with reference to FIGS. 3 and 4. FIG. 3 illustrates the relationship of the lefthand half of the deflecting vanes 4, wheras FIG. 4 illustrates the relationship of the righthand half of the deflecting vanes 4. Incidentally, angles $\theta$, $\alpha$, $\beta$, $\gamma$ and $\delta$ appearing in FIGS. 3 and 4 are all indicated to have such absolute values as are expressed by following inequalities: $0<\alpha<\theta<\beta<90$ $<180$ $-\gamma<180$ $-\theta<180$ $-\delta$. In the states $b_1$ and $a_1$ shown in FIG. 3($b_1$) and FIG. 4($a_1$), a force $F_1$ for imparting the clockwise moment is exerted. In the states $b_2$ and $a_8$ in FIG. 3($b_2$) and FIG. 4($a_8$), a force $F_2$ for imparting the clockwise moment is exerted. In the states $b_3$ and $a_7$ shown in FIG. 3($b_3$) and FIG. 4($a_7$), a force $F_3$ for imparting the clockwise moment is exerted. In the states $b_4$ and $a_6$ shown in FIG. 3($b_4$) and FIG. 4($a_6$), a force $F_4$ for imparting the clockwise moment is exerted. In the states $b_5$ and $a_5$ shown in FIG. 3($b_5$) and FIG. 4($a_5$), no rotating force is imparted. In the states $b_6$ and $a_4$ shown in FIG. 3($b_6$) and FIG. 4($a_4$), a force $F_5$ for imparting the counter-clockwise moment is exerted. In the states $b_7$ and $a_3$ shown in FIG. 3($b_7$) and FIG. 4($a_3$), no rotating force is imparted. In the states $b_8$ and $a_2$ shown in FIG. 3($b_8$) and FIG. 4($a_2$), a force for imparting the clockwise moment is exerted. Incidentally, the forces $F_1$, $F_2$, $F_3$, $F_4$, $F_5$ and $F_6$ thus far described have different magnitudes, as shown, but they are the forces to be exerted upon a unit area so that the force to be really exerted upon the aforementioned deflecting blades 4 is the resultant one which is multiplied by their areas. Hence, if the total area is small even if the aforementioned forces have large magnitudes, the resultant force is accordingly reduced. If the total area is large even if the aforementioned forces have small magnetudes, the resultant force is accordingly strengthened. On the other hand, the forces illustrated in FIGS. 1, 2, 3 and 4 are concerned with the deflecting vanes 4 extending through the pivot 5. Therefore, in case a multiplicity of deflecting vanes are so radially formed as to extend through the aforementioned spindle 5, the blown angles $\theta$ for the respective deflecting vanes are constant. On the contrary, in case a multiplicity of deflecting vanes are formed in parallel with the aforementioned deflecting vanes 4 extending through the aforementioned spindle 5, the blown angles $\theta$ for the respective deflecting vanes are variable. However, the relationship between the blown angle $\theta$ and the inclined angle $\theta_o$ of the deflecting vanes 4 is similar. In the following description, therefore, the states, in which the deflecting vanes are formed, will be described to be the state $a_1$, the state $b_1$ and so on. In the case is formed a wind deflector which are composed of a multiplicity of the aforementioned deflecting vanes 4, the clockwise moment and the counter-clockwise moment can be set in such a relationship in force as can ensure a proper rotating speed at a suitable time, and the blown direction can be either expanded over a wide range or concentrated.

Next, the blower, which is equipped with the wind deflector formed in accordance with the aforementioned respective states, will be described with reference to FIGS. 5 to 25.

Numeral 11 indicates a blower according to the present invention which is constructed to include front and rear housing members 13 and 14, which are made separatable of a synthetic resin for forming a wind tunnel 12, a rear guard 15, which is made of a synthetic resin and which is removably mounted in the rear opening of the wind tunnel 12, and a wind deflector 16 which is made of a synthetic resin and which is rotatably disposed in the front opening of the wind tunnel 12.

The aforementioned front and rear housing members 13 and 14 are jointed together by the elastic connection of an elastic rim 17 and an engagement hole 18 and are then so fixed by means of a not-shown screw that they are not easily disassembled. The front and rear housing members 13 and 14 thus jointed construct such a box-shaped body as can be easily carried place to place and as has a generally square shape in front elevation and rectangular shapes in side elevation and in top plan view. The front housing member 13 is formed at the center of the wind tunnel 12 with a motor mounting portion 19, which is supported in the wind tunnel by means of a plurality of supporting ribs 20 extending radially therefrom into the wind tunnel and which is formed integrally with the front housing member 13.

An axial flow fan 24 is so fixed on the shaft 23 of rotation of the aforementioned motor 21 by means of a nut 25 that it is disposed in the aforementioned wind tunnel 12. The aforementioned front housing member 13 is formed at its upper portion with a space 27 for accommodating electric accessories such as a motor control switch 26 and a timer, the operating portions of which are formed to protrude from the upper face of the aforementioned front housing member. The aforementioned supporting rib 20a extending upright from the motor mounting portion 19 is formed with a code guide groove 29 through which a power supply cord 28 to the motor 21 extends. Said groove 29 is formed therein with a projection for retaining the power supply cord 28. The supporting ribs 20 other than that formed with the aforementioned groove 29 are formed into such a plate shape as to slightly straighten the twist of the swirling air flow generated by the aforementioned axial flow fan 24 into an air flow having an intense rectilinearity. However, the air flow thus straightened is not a completely straight wind but has a predetermined blown angle $\theta$.

A handle 30 is formed on an upper back face of the aforementioned rear housing member 14. This member 14 is formed with a receiving portion 31 which is so extended to receive the lower face of the aforementioned front housing member 13. Foldable legs 32 are hinged to both the sides of the lower face of said receiving portion 31 so that the aforementioned blower 11 can be positioned as a whole to face obliequely upward by erecting the legs 32. From both the sides of the lower face of the rear housing member 14, there extend supporting stands 33 which protrude in the opposite directions to the receiving portions 31 and to which elastic heels 34 made of rubber or the like are fixed at the lower sides of their leading ends by means of screws.

The aforementioned wind tunnel 12 is constructed by assembling the front and rear housing members 13 and 14, and the aforementioned rear guard 15 is removably mounted in the rear opening of the wind tunnel of the rear housing member 14 either by the elasticity of the guard itself or by a clamping method. The rear guard 15 is constructed of several radial ribs 35 and a multiplicity of annular ribs 36, both of which are formed to have generally elliptical sections. The annular ribs 36 are so inclined that their longer axes are extended the more to the outside as they are spaced the more from the center to the outer circumference. As a result, the air to be sucked through the rear guard 15 into the aforementioned fan 24 is guided smoothly with little resistance so that the fan 24 can enjoy an enhanced sucking efficiency and a lowered noise level. The rear guard 15 is formed at its central portion with a cover plate 37 which covers the aforementioned nut 25 positioned at the center of the fan 24. As a result, that nut 25 need not be a decorative one which has been used to secure the fan according to the prior art.

To the front face of the aforementioned motor mounting portion 19, there is fixed by means of screws 40 a mounting plate 39 which has a spindle 38 protruding at its center. The mounting plate 39 acts as a reinforcement plate for the motor mounting portion 19 so that the motor 21, i.e., a heavy part can be stably supported. On the spindle 38, there is rotatably mounted an intermediate rotor 46 which is formed with: a stem 42 fitted in the center hole 41 of the wind deflector 16; a flanged portion 43 abutting against the back of the wind deflector 16; and a threaded portion 45 into which such a spinner 44 is screwed as clamps the wind deflector 16 between itself and the flanged portion 43. The intermediate rotor 46 thus formed is prevented from coming out by the head of a screw 47 which is screwed in the leading end of the stem 2. The fitting relationship between the center hole 41 and the stem 42 is effected to prevent their relative rotations so that the wind deflector 16 and the intermediate rotor 46 are rotated together. By molding the stem 38 of a metal rod and by molding the intermediate rotor 46 of an oilless resin, the frictional resistance between the stem 38 and the intermediate rotor 46 can be reduced to further smoothen the rotations of the wind deflector 16. By selecting the molding materials of the stem 38 and the intermediate rotor 46, on the other hand, a suitable frictional resistance can be attained contrary to the foregoing description. By mounting a ball bearing in the intermediate rotor 46, moreover, the rotations of the rotor 46 can be further smoothened. In either case, the wind deflector 16 can be molded of a variety of materials having their strengthes or the like taken into consideration.

In the upper corner of the aforementioned front housing member 13, there is mounted a stopper mechanism 50 which is adapted to be brought into and out of engagement with one of engagement projections 49 formed on the outer circumferential frame 48 of the wind deflector 16 (Reference should be made especially to FIGS. 8 to 12.). The stopper mechanism 50 is constructed to include: a stopper lever 51, which is made engageable with the engagement projections 49 of the deflector 16; a spring 52 for biasing the stopper lever 51 in the engaging direction; and an operating member 53 for holding the stopper lever 51 in a stand-by position against the force of the spring 52. The stopper mechanism 50 thus constructed is mounted in a space 54 which is formed in the aforementioned front housing member 13. The space 54 is formed with a groove 55 in which the stopper lever 51 is held in a sliding manner. The groove 55 is formed at its one side with a through hole 56 which is opened into the wind tunnel 12 thereby to allow a retaining end 57 formed at the end of the stopper lever 51 to protrude into the wind tunnel 12. The groove 55 is formed at its other end with a notch 59 through which an operating lever 58 formed at the other end of the stopper lever 51 is allowed to protrude into the space 54. Moreover, the other end of the stopper lever 51 is formed with a grooved portion 60 which holds one half of the spring 52 therein while allowing the other half of the spring 52 to protrude into the space 54 until it leading end retained on the inner wall of the space 54. When the stopper lever 51 is biased by the spring 52 to have its retaining end 57 protruding into the wind tunnel 12, the operating lever 58 abuts against the end edge of the notch 59 in which it is positioned. Reference numeral 61 indicates a cam plate which is made operative to shift the operating lever 58 against the action of the spring 52 thereby to hold the stopper lever 51 in the stand-by-position. A cam shaft 62 for turning the cam plate 61 is formed to protrude into the front face of the front housing member 13 through a bearing hole formed in the member 13 and to have its end portion to which an operating knob 63 is fixed. In the cam plate 61, moreover, there is fitted a clutch ball 65 which is biased to the outside by means of a spring 64 and which is made selectively engageable with engagement holes 67 and 67 formed in a cover 66 covering the space 54 thereby to hold the cam plate 61 in a position, in which the operating lever 58 is shifted, or in a position in which it is out of abutting engagement with the operating lever 58. When the retaining end 57 protrudes into the aforementioned wind tunnel 12, it is merely biased by the spring 52 so that it is easily retracted by the pushing action from the wind tunnel 12. As a result, even if the wind deflector 16 is removed in the stopped state of the wind deflector 16, the retaining end 57 can be removed without any resistance, even if the wind deflector 16 is removed. Moreover, even if the retaining end 57 abuts against one of the engagement projections 49 when it is to be attached, it is retracted by the pushing action of the wind deflector 16 so that it can be attached without any resistance.

The wind deflector 16 is composed of an outer circumferential portion, which is formed with a first group of vanes, an inner circumferential portion, which is formed with a second group of vanes, and a central portion. The outer circumferential portion has its two upper and lower thirds formed with a plurality of wind deflecting vanes 70, which are arranged in parallel, and its one middle third formed with a pair of wind deflectors 72 which are rotatably disposed and each of which is formed with a plurality of such rotating changing vanes 71 as are arranged in parallel with the wind deflecting vanes 70. The aforementioned inner circumferential portion is formed with a plurality of wind deflecting vanes 73 which radially extend from the aforementioned central portion to the outer circumferential portion. The central portion is formed with both the aforementioned center hole 41 and a recessed portion 74 in which a gear mechanism for making the wind deflectors 72 coactive is accommodated. A shorter pin 76 is formed to project from the center of that portion of the outer frame 75 of one of the aforementioned wind deflectors 72, which faces the outer circumferential frame 48 of the aforementioned wind deflector 16, and a longer pin 78 is formed to protrude from the center of that portion of the inner frame of the wind deflector 72, which faces the inner circumferential frame 77 of the wind deflector 16. The outer circumferential frame 48 is formed with bearing holes 79 for bearing the aforementioned shorter pins 76. The inner circumferential frame 77 and the outer side frame 80 of the recessed portion 74 of the aforementioned central portion are formed with bearing notched portions 81 and 82 for bearing the aforementioned longer pins 78. The portions formed with the bearing notched portions 81 and 82 are formed between the inner circumferential frame 77 and the outer side wall 80 with the aforementioned wind deflecting vanes 73, and through grooves 83 merging into the notched portions 81 and 82 are formed along the end edge portions of the wind deflecting vanes 73. The aforementioned longer pins 78 are formed at their end portions with bevel gears 84. In the aforementioned recessed portion 74, there is fitted an annular bevel gear 85 which is in meshing engagement with the two bevel gears 84 and 84 for making the two wind deflectors 72 and 72 coactive. The bearing holes 79 and the notched portions 81 and 82 have their peripheral edges formed with lands 86, 87 and 88 at their sides facing the wind deflectors 72 and the bevel gears 84. The outer circumferential frame 48 and the inner circumferential frame 77 are formed with circumferentially extending lands 89 and 90 on their front sides facing the wind deflectors 72. These wind deflectors 72 are formed on the outer sides of the outer frame 75, which are formed with the shorter and longer pins 76 and 78, with semicircular lands 91 and 92 which enclose one-side halves of the shorter and longer pins 76 and 78 and which have a substantially equal internal radius to the external radius of the aforementioned lands 86 and 87. Furthermore, those outer sides of the outer frames 75, which are formed with the shorter and longer pins 76 and 78, are formed at both their ends with elastic pawls 93 and 94 which have free end protrusions at their one halves formed with the lands 91 and 92 and which have base end connecting portions at their other halves. The aforementioned bevel gears 84 are formed with semicircular lands 95 which enclose the one-side halves of the longer pins 78 and which have a substantially equal internal radius to the external radius of the aforementioned land 88.

Figure 16A:
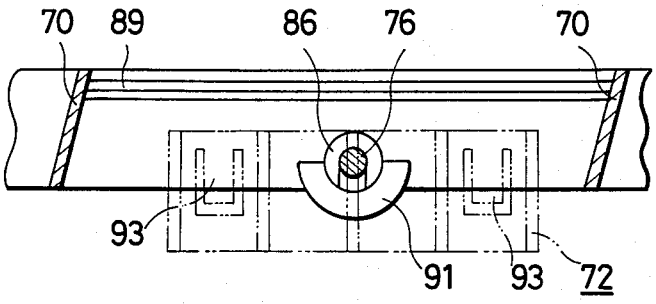
Figure 16:
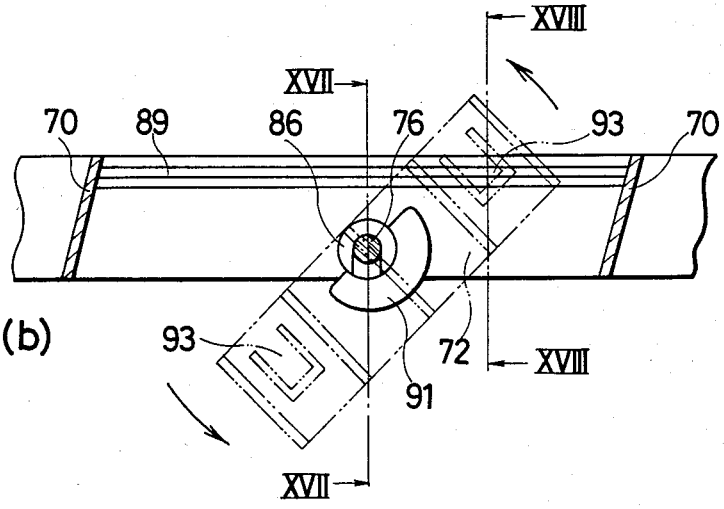
Figure 16C:
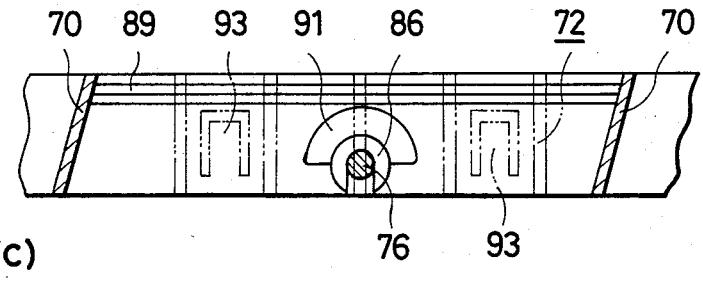
Figure 17:
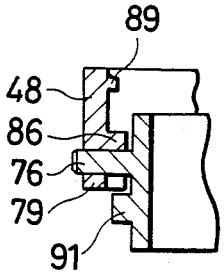
Figure 18:
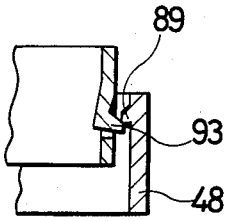
Figure 19:
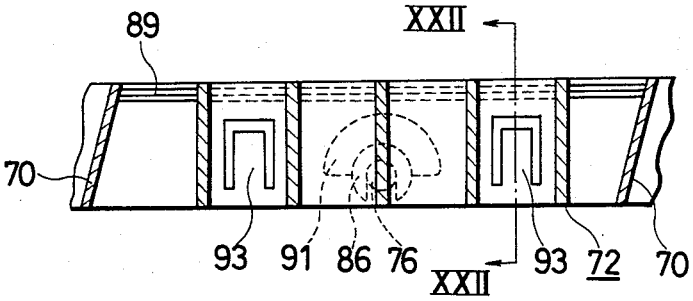

Next, the method of mounting the wind deflectors 72 and 72 and the annular bevel gear 85 on the wind deflector 16 will be described with reference to FIGS. 16 to 18. First of all, the annular bevel gear 85 is fitted in the recessed portion 74, and the shorter pins 76 of the wind deflectors 72 are inserted into the bearing holes 79. After that, the longer pins 78 are fitted in the notched portions 81 and 82 and in the through grooves 83. At this time, both the lands 86, 87 and 88, which are formed on the outer circumferential frame 48, the inner circumferential frame 77 and the other side wall 80, and the lands 91, 92 and 95, which are formed on the wind deflectors 72, have their respective open ends abutting against each other, as shown in FIG. 16(*a*), so that they provide no obstruction when the shorter and longer pins 76 and 78 are to be borne. Simultaneously as the wind deflectors 72 are mounted, the bevel gears 84 are fitted in the aforementioned recessed portion 74, whereupon the annular bevel gear 85 is so pushed and held in the recessed portion 74 that it is prevented from coming out. In this state, both the bevel gears 84 and 84, and 85 are held in meshing engagement with each other. Next, if the wind deflectors 72 are turned in the direction of arrows, as shown in FIG. 16(*b*), their lands 91, 92 and 95 are turned along the outer circumferences of the lands 86, 87 and 88 of the outer and inner circumferential frames 48 and 77 and the outer wall 80, and the elastic pawls 93 and 94 ride over the lands 89 and 90, which extend in the circumferential directions of the outer and inner circumferential frames 48 and 77, as shown in FIG. 18, until they come into a state, in which they are turned 180 degrees, as shown in FIG. 16(*c*). The riding operations of the elastic pawls 93 and 94 over the lands 89 and 90 are effected smoothly as a result that the elastic pawls 93 and 94 move from the base end connecting portions to the free end protruding portions relative to the lands 89 and 90 so that they are smoothly warped in the direction to leave from the lands 89 and 90. In the state in which the wind deflectors 72 are attached, i.e., as shown in FIG. 16(*c*), since the lands 91, 92 and 95 are positioned to engage with the lands 86, 87 and 88, the longer pins 78 do not come out of engagement with the notched portions 81 and 82 and the groove 83 so that the wind deflectors 72 are borne without fail. The assembling operations of the wind deflectors 72 and 72 and the annular bevel gear 85 are easily performed without requiring any special mounting members such as screws.

Figure 20:
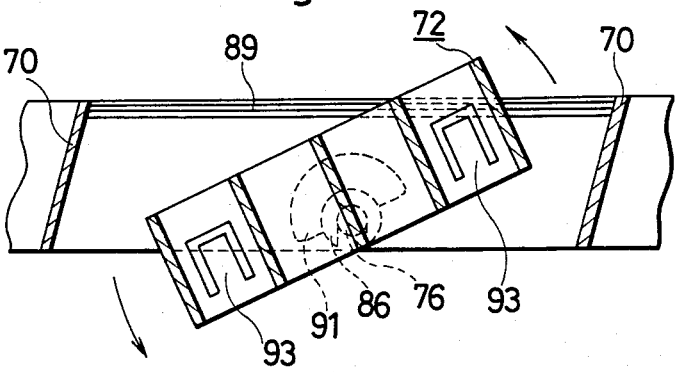
Figure 21:
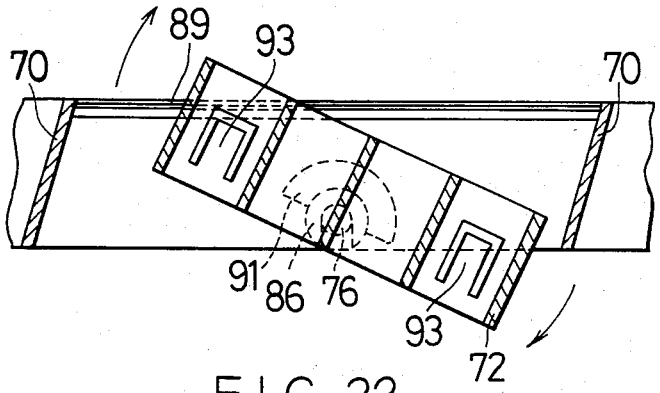
Figure 22:
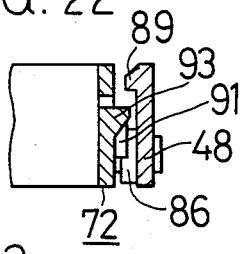
Figure 23:
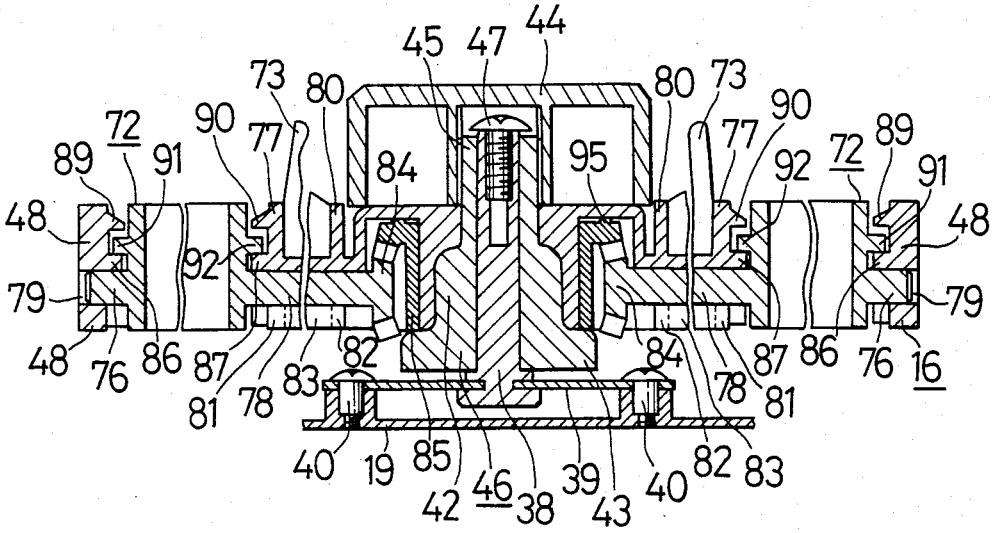
Figure 24:
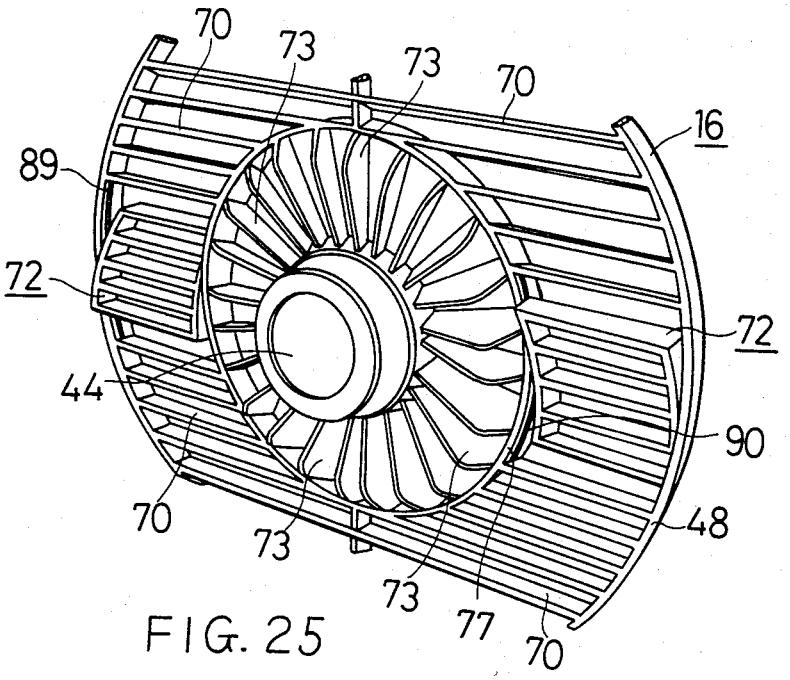
Figure 25:
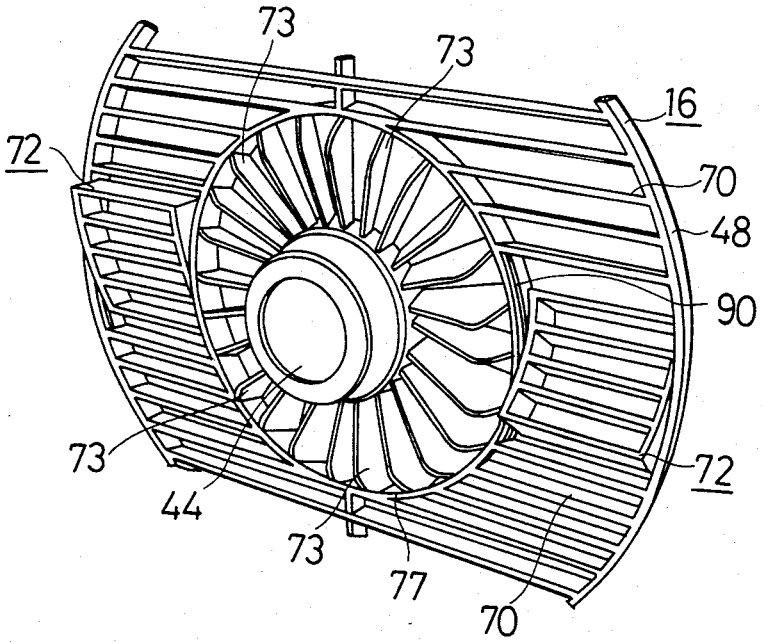
Figure 26:
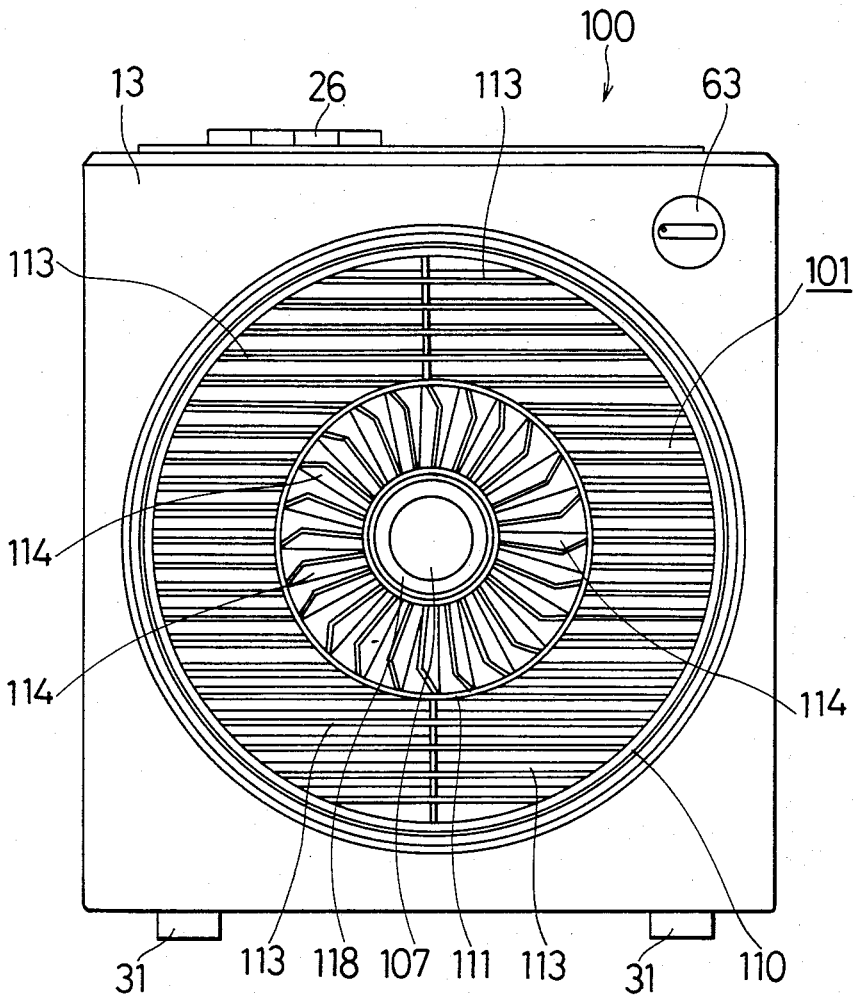
In FIGS. 26 to 29 showing a second embodiment of the present invention.
Figure 28:
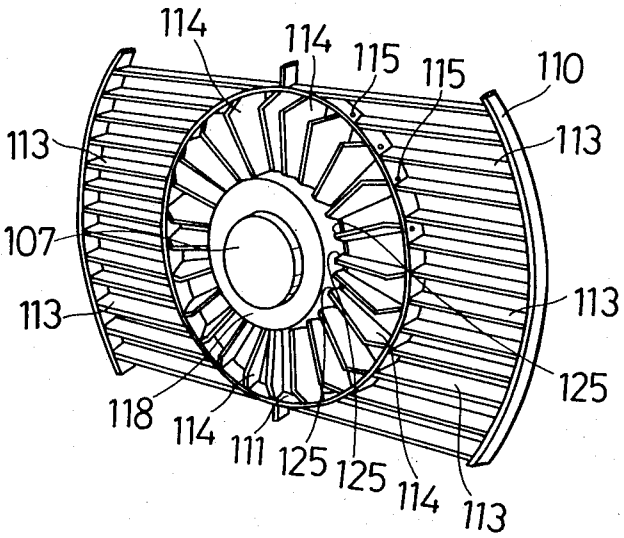
Figure 27:
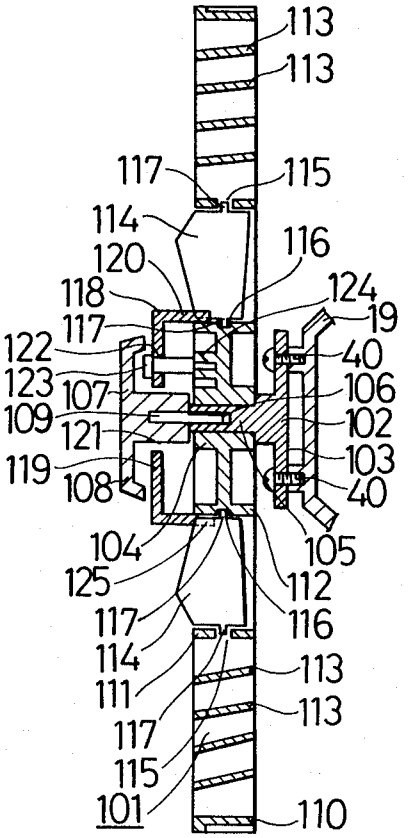
Figure 29:
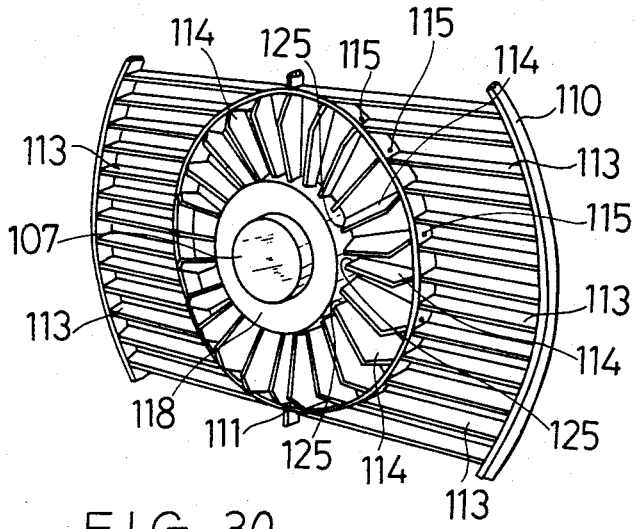
Figure 30:
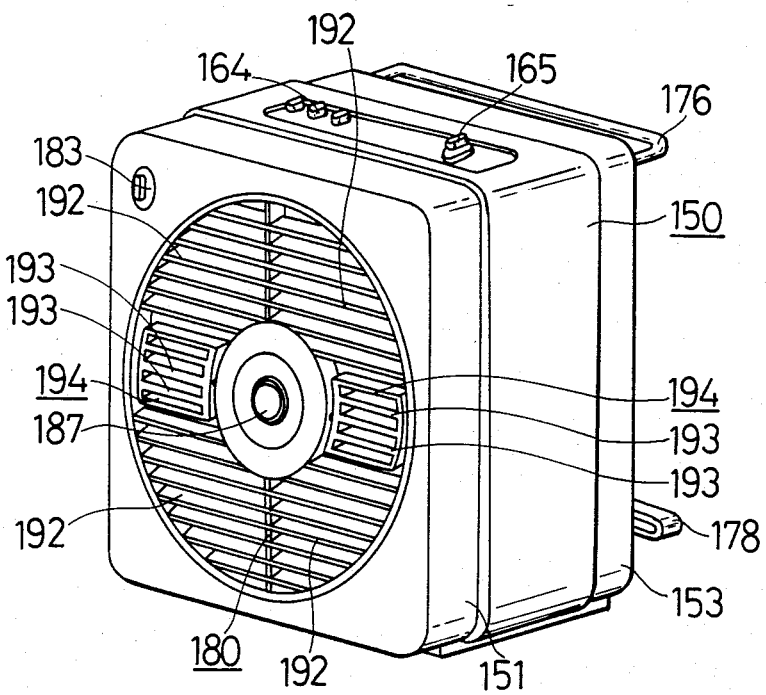
In FIGS. 30 to 38 showing a third embodiment of the present invention.
Figure 31:
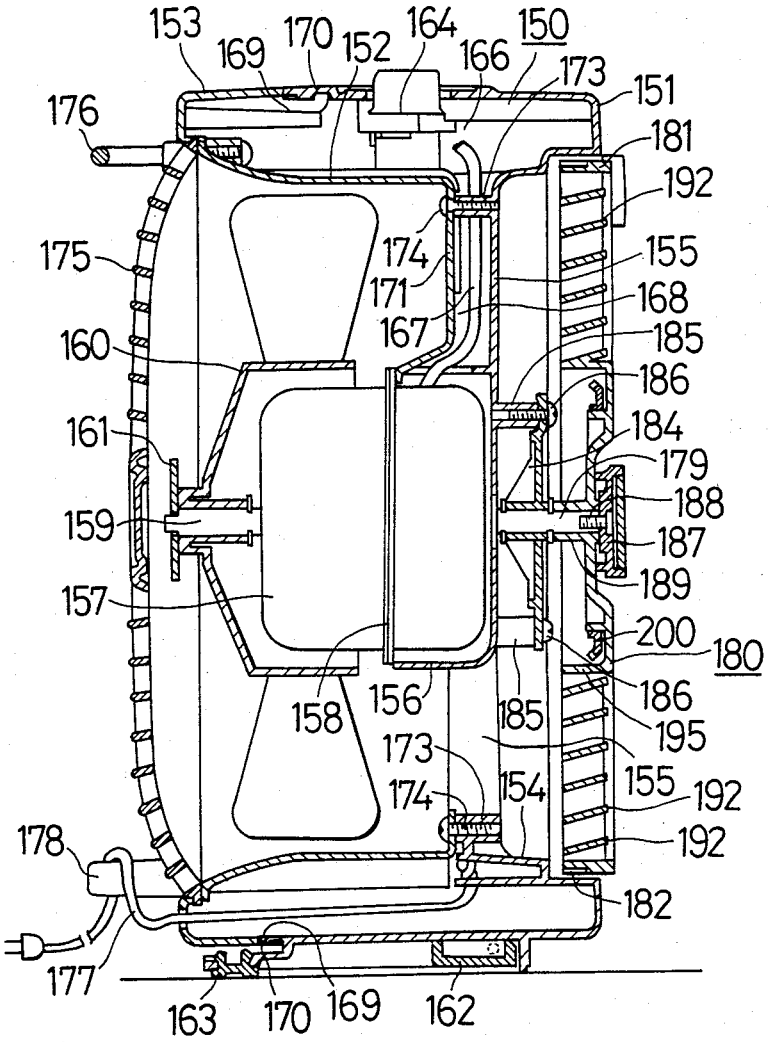
Figure 32:
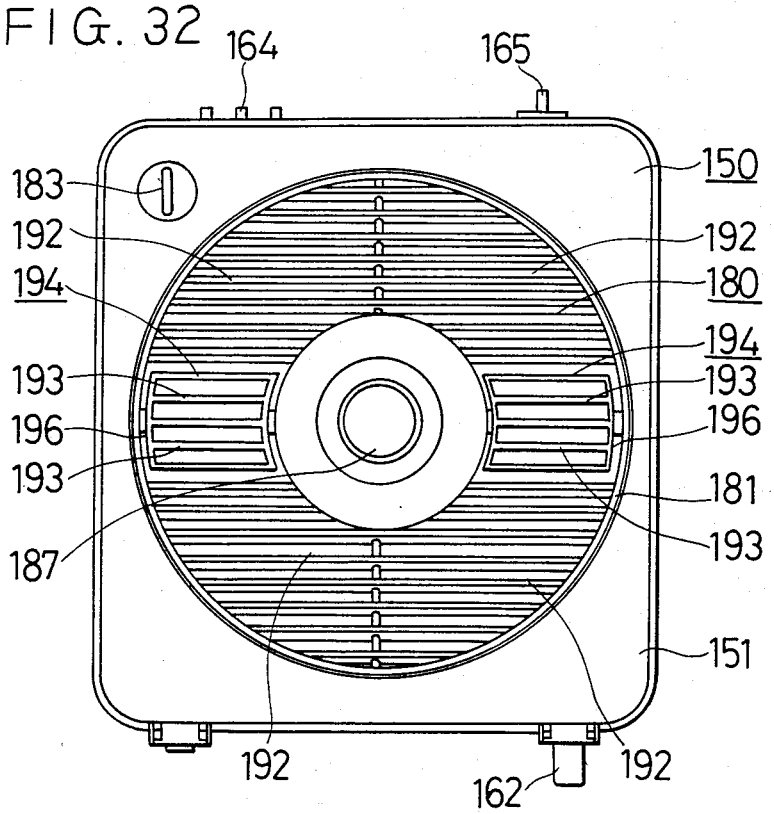
Figure 33:
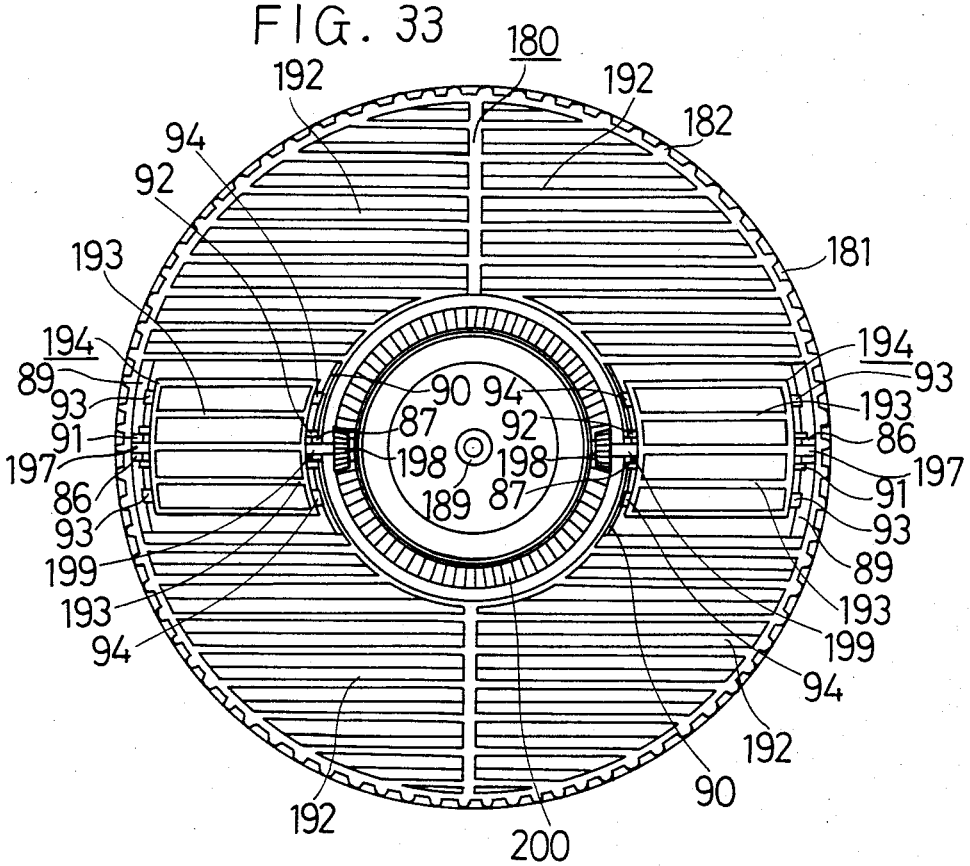
Figure 34:
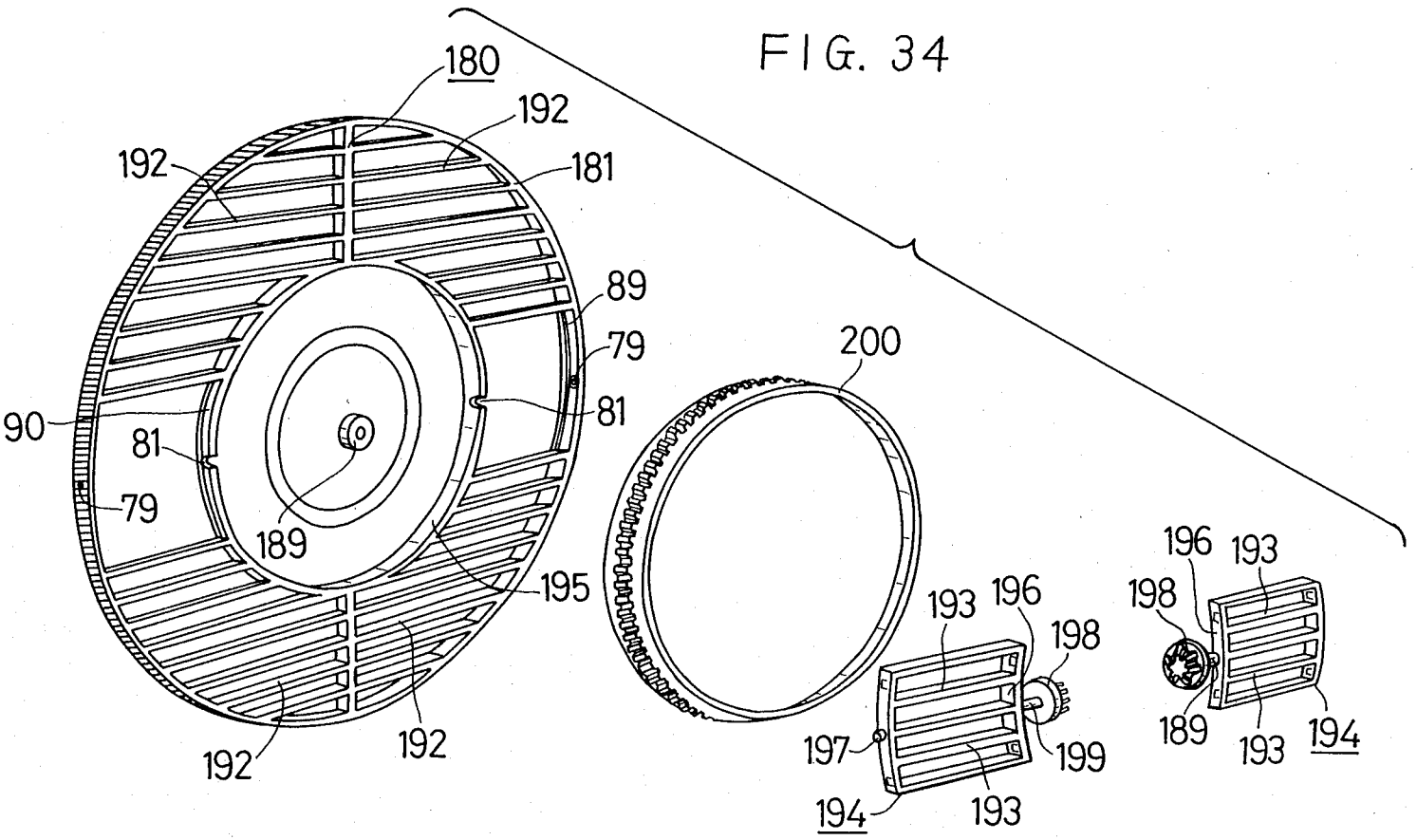
Figure 35:
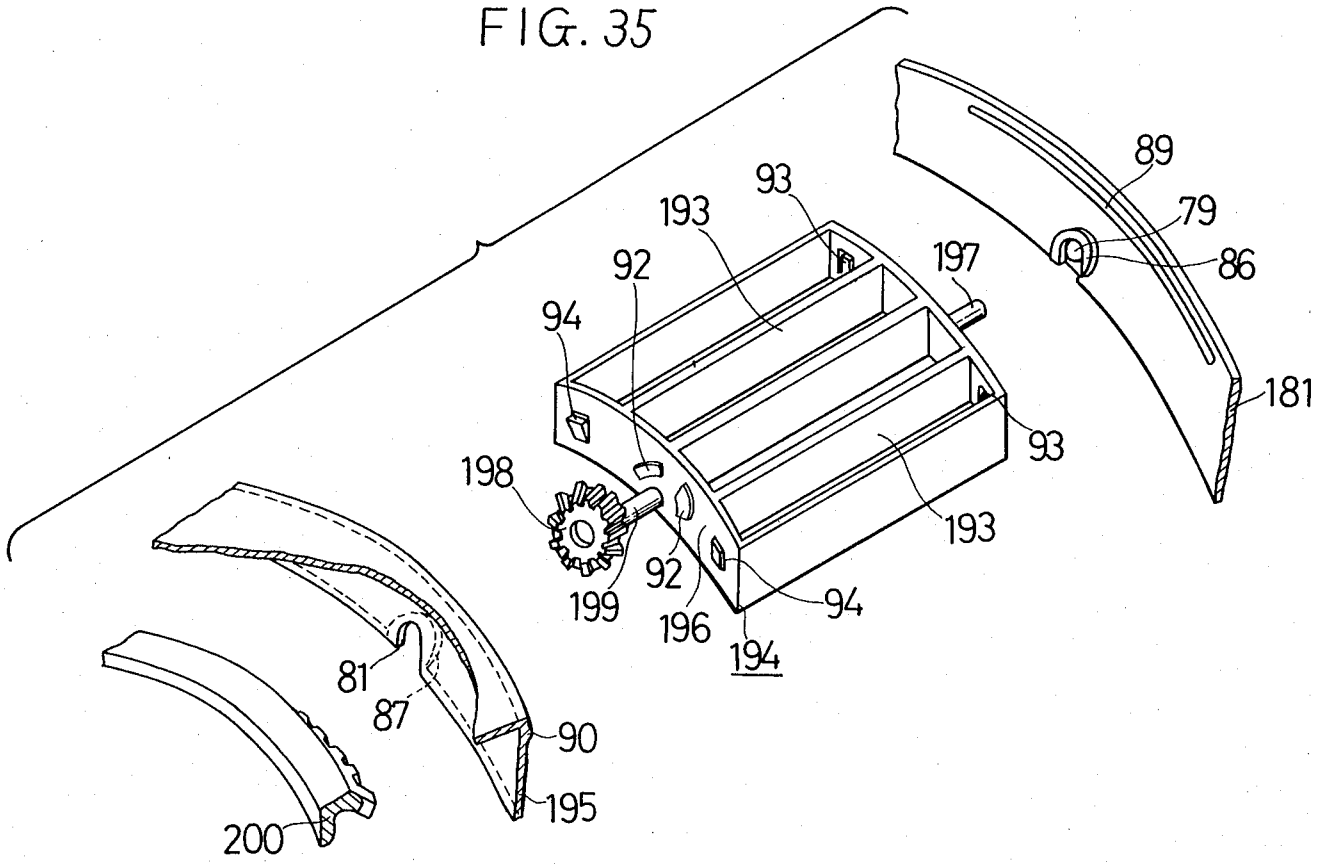
Figure 36:
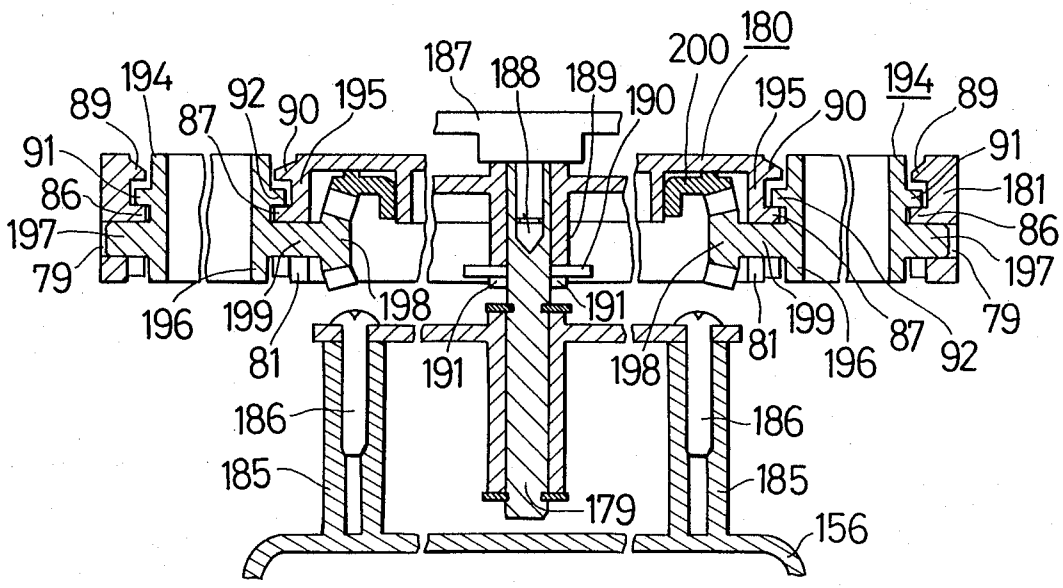
Figure 37:
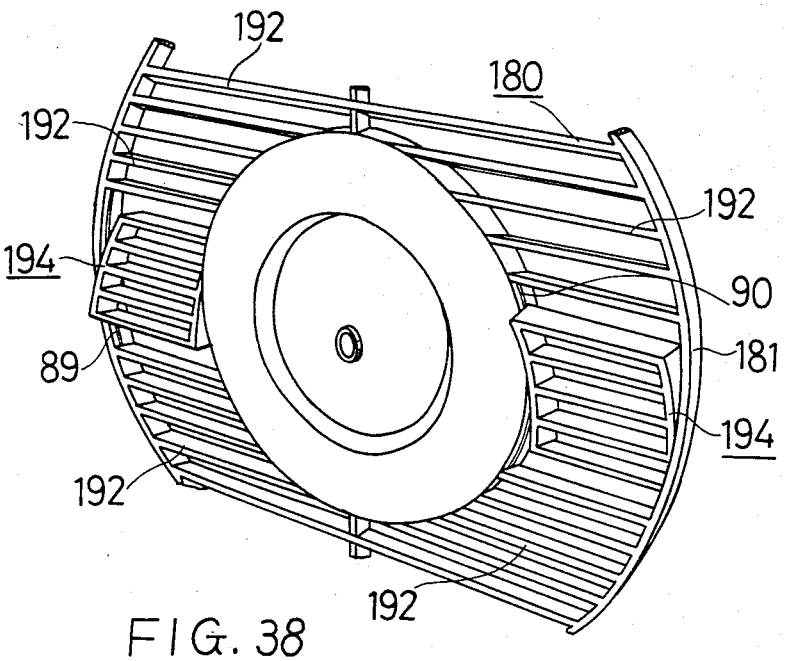
Figure 38:
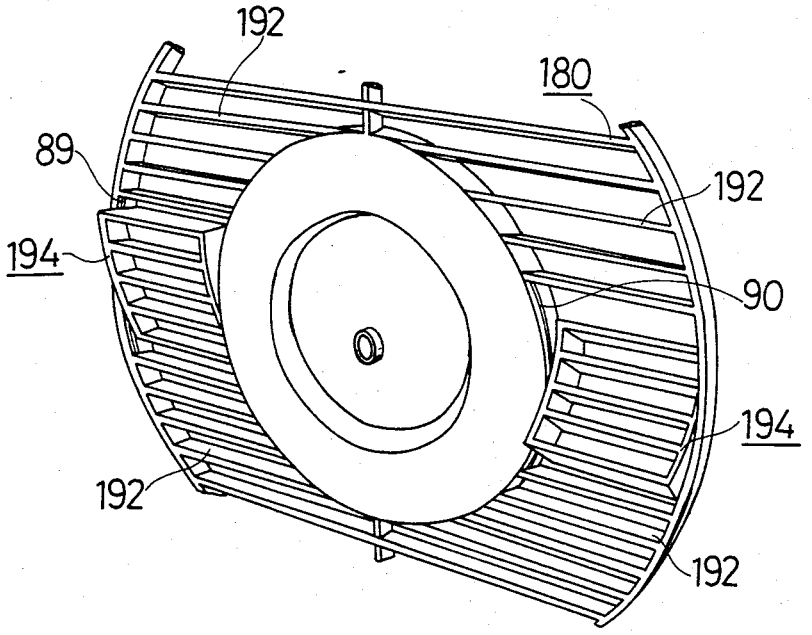

The rotating operations of the wind deflectors 72 thus constructed will be described with reference to FIGS. 19 to 25. Each of the wind deflectors 72 is blocked from rotating to this side because one of the elastic pawls 93 and 94 is brought into abutment engagement with the aforementioned lands 89 and 90 if the wind deflector 72 is turned to this side, as shown in FIG. 20. On the contrary, if the wind deflector 72 is turned to the opposite side, as shown in FIG. 21, the other of the elastic pawls 93 and 94 is brought into abutment engagement with the lands 89 and 90 so that the wind deflector 72 is blocked from rotating to that opposite side. The abutment engagement of the elastic pawls 93 and 94 with the lands 89 and 90 is not released as a result that the elastic pawls 93 and 94 are not warped, because their free end protruding portions abut. As a result, the aforementioned wind deflector 72 can be smoothly operated within a predetermined range. Moreover, both the wind deflectors 72 and 72 are so made coactive with each other by means of the aforementioned annular bevel gear 85 that, by turning one of the wind deflectors 72 to this side, the other wind deflector 72 is turned to the opposite side. Merely by operating one of the wind deflectors 72, moreover, the other wind deflector 72 can be operated. The hold of the wind deflectors 72 in the suitably turned operating position is effected by the combined actions of the frictional forces between the lands 86, 87 and 88 and the lands 91, 92 and 95, the meshing resistances between the bevel gears 84 and 84 and the annular bevel gear 85, and the frictional force between the annular bevel gear 85 and the recessed portion 74 so that it requires no special construction. In order that the frictional force between the annular bevel gear 85 and the recessed portion 74 may become an effective one for holding the wind deflectors 72 and 72, in the present embodiment, the aforementioned wind deflector 16 is so formed that it is clamped under pressure between the bottom of the recessed portion 74 and the aforementioned flanged portion 43 when it is mounted on the aforementioned intermediate rotor 46 by means of a neck piece. This clamp under pressure is prevented from becoming excessive by forming the annular land 95 at the abutting portion of the annular bevel gear 85 against the bottom of the recessed portion 74.

The fixed wind deflecting vanes 70 and 73 of the wind deflector 16 shown in FIGS. 5 to 25 are so formed, as shown in the states of FIGS. 3 and 4, that the lefthand half of the wind deflecting vanes 70 arranged in parallel has the larger angles of inclination in the downward direction, as held in the states $b_1$, $b_2$, $b_3$, $b_4$ and so on in this order. As a result, there is exerted upon the lefthand half a force $F_R$ for rotating the wind deflector 16 in the clockwise direction. If the wind deflecting vanes 70 at the righthand half are so formed to be changed downwardly at the angle equal to that of those at the lefthand side, a force $F_r$ for effecting clockwise rotations is exerted within the range of the states $a_1$, $a_2$ and $a_3$, but a force $F_l$ for effecting counter-clockwise directions is exerted within a range of the state $a_4$. The wind deflecting vanes 73 formed into the radial shape are formed at such an inclination as to effect the states $b_6$ and $a_6$. As a result, a force $F_L$ for rotating the wind deflector 16 in the counter-clockwise direction is exerted. As a result, the wind deflector 16 is rotated by the difference between the sum of the clockwise forces of $F_R+F_r$ and the sum of the counter-clockwise forces of $F_L+F_l$, and the present embodiment is so set as to effect a proper use r.p.m. (which will be referred to as a "moderate speed" hereinafter) in the clockwise direction. At this time, the wind deflectors 72 are held in the positions, in which their wind deflecting vanes 71 are in the states $b_7$ and $a_3$, so that no force contributing to the rotations is exerted. The wind deflectors 72 of the present embodiment are operated in accordance with their construction, when they are rotationally operated, such that one is in the state $b_1$ whereas the other is in the state $a_1$, such that one is in the state $b_2$ whereas the other is in the state $a_8$, such that one is in the state $b_3$ whereas the other is in the state $a_7$, such that one is in the state $b_4$ whereas the other is in the state $a_6$, such that one is in the state $b_6$ whereas the other is in the state $a_4$, such that one is in the state $b_7$ whereas the other is in the state $a_3$, and such that one is in the state $b_8$ whereas the other is in the state $a_2$. As a result, the forces in the same directions are exerted upon the wind deflectors 72 and 72. If the wind deflector 72 is rotated from the state $b_7$ to the states $b_1b_2$, $b_3$, $b_4$ and $b_8$, the clockwise force $F_R$ is exerted upon the wind deflectors 72 and 72 so that the clockwise force $2F_R$ are exerted upon the wind deflector 16 to have its r.p.m. increased (as will be referred to a "high speed" hereinafter). On the other hand, if the wind deflectors 72 and 72 are rotated to the state $b_6$, the counter-clockwise force $F_L$ is exerted upon the deflectors 72 and 72. As a result, the counter-clockwise force $2F_L$ is additionally exerted upon the wind deflector 16 so that the rotating speed is decreased to an r.p.m. (which will be referred to as a "low speed" hereinafter) until the force is overlapped upon the force to obtain the aforementioned moderate speed. When the aforementioned force $2F_L$ exceeds the force to obtain the moderate speed, the r.p.m. takes a negative value so that the wind deflector 16 is rotated counter-clockwise (which will be referred to as a "reversed rotation" hereinafter). Thus, by rotationally operating the wind deflectors 72 and 72 mounted in the aforementioned wind deflector 16, the rotations of this wind deflector 16 can be changed in a stepless manner among the high speed, the moderate speed, the low speed and the reversed rotation.

Incidentally, the wind deflectors 72 and 72 in the first embodiment thus far described can be coactively operated. It is, however, apparent that the wind deflectors 72 and 72 need not be made coactive but can be rotated independently of each other. In the first embodiment thus far described, each of the wind deflectors 72 is composed of a group of five wind deflecting vanes 71, but more wind deflectors 72 may be interposed between the aforementioned outer circumferential frame 48 and a reinforcement frame 96, which divides the aforementioned inner circumferential frame 77 and the wind deflector 16 at their centers, such that the wind deflecting vanes 70 and 71 are made rotatable. Moreover, the wind deflecting vanes 70 and 73 need not be provided in the states having been described in connection with the first embodiment, but similar operational effect on those of the aforementioned ones can be attained by suitably combining the various states shown in FIGS. 3 and 4.

In the first embodiment thus far described, the wind deflecting vanes 70 and 71 formed in the outer circumferential portion of the wind deflector 16 are made movable. As shown in FIGS. 26 to 29, however, the wind deflecting vanes 73 formed radially in the inner circumferential portion may be made movable. The present invention will be described in the following in connection with a second embodiment thereof with reference to FIGS. 26 to 29.

A blower 100, as shown, is constructionally different from the aforementioned blower 11 of the first embodiment exclusively in the a wind deflector 101 and in the structure for bearing the wind deflector 101 but is identical thereto in the internal and external constructions of the front and rear housing members 13 and 14 so that their illustrations and descriptions are omitted. Incidentally, the identical constructional parts are indicated at the identical reference numerals.

A mounting plate 103, which is formed with such a protruding spindle 102 as is fixed by means of the screws 40 to the motor mounting portion 19 formed in the front housing member 13, is molded of a synthetic resin. The spindle 102 is formed with a bearing portion 105 which bears a cylindrical through hold 104 formed at the center of the wind deflector 101. This wind deflector 101 is prevented from coming out of the spindle 102 by means of a spinner 107 which is screwed in a threaded hole 106 formed in the leading end portion of the spindle 102. Said spinner 107 is formed by molding to bury a screw 109 in the stem portion of a mushroom-shaped operating portion 108 made of a synthetic resin. The wind deflector 101 is born with little friction resistance in the bearing portion 105 while being in a state in which its stem portion has its leading end face abutting against the leading end of the spindle 102.

The wind deflector 101 is composed of an outer circumferential portion, an inner circumferential portion and a central portion, all of which are divided by an outer circumferential frame 110, an inner circumferential frame 111 and an outer central frame 112. The aforementioned outer circumferential portion is formed with a plurality of wind deflecting vanes 113 which are arranged in parallel and which have their angle of inclination fixed. The inner circumferential portion is formed with a plurality of wind deflecting vanes 114 which are so radially arranged as to connect the outer central frame 112 and the inner circumferential frame 11 and which are rotatably disposed. The aforementioned inner circumferential frame 111 is formed with bearing holes 115 which are arranged in an equal pitch and in a number equal to that of the wind deflecting vanes 114. The outer central frame 112 is formed with bearing holes 116 which are arranged in an equal pitch and at positions to face the bearing holes 115. The wind deflecting vanes 14 are formed at both their end edges with pivot pins 117 and 117 which protrude therefrom. The wind deflecting vanes 114 are attached by warping them by making use of their elasticities and by inserted and bearing the pivot pins 117 and 117 in the bearing holes 115 and the bearing holes 116. In the aforementioned central portion, there is mounted an operating member 118 which is made operative to make the wind deflecting vanes 114 coactive with one another. The operating member 118 is constructed to include: a disc portion 119, which covers the central portion, and an annular rib portion 120 which is formed on the outer circumferential portion of the disc portion 119 and fitted on the outer surface of the outer central frame 112. The disc portion 119 is formed at its center with an opening 121 through which the stem portion of the spinner 107 extends. Moreover, the disc portion 119 is formed with an arcuate slit 122 which is curved around the opening 121. After the operating member 118 has been fitted in the aforementioned central portion, screws 123, which are formed with threaded portions on at their leading ends, are inserted into the arcuate slit 122 and have their threaded portions screwed into a hub 124 which is formed to protrude from the aforementioned central portion. As a result, the aforementioned operating member 118 is mounted by the aforementioned screws 123 in the aforementioned central portion without coming out and is guided by the outer central frame 112 so that it can be rotated while having its rotational range regulated by the coactions of the aforementioned arcuate slit 122 and screws 123. The aforementioned annular rib portion 120 is formed at its end portion with notches 125 which are in the number equal to that of the aforementioned wind deflecting vanes 114. When the operating member 118 is mounted in the aforementioned central portion, the aforementioned notches 125 are fitted in the front edges of the aforementioned wind deflecting vanes 114. As a result, the wind deflecting vanes 114 can be coactively rotated by the rotating operation of the operating member 118.

The wind deflecting vanes 113 formed in the aforementioned outer peripheral portion will be described in connection with the aforementioned states of FIGS. 3 and 4. The wind deflecting vanes 113 are constructed such that the vanes 113 at the lefthand half side have their angles $\theta_0$ of inclination changed in the states $b_1$, $b_2$, $b_3$ and $b_4$ in the downward direction of the wind deflector 101 whereas the vanes 113 at the righthand half side have their inclination angles $\theta_0$ changed in the states $a_1$, $a_2$, $a_3$ and $a_4$ in the same direction of the deflector 101. As a result, a force $F_R'$ for effecting the clockwise rotations is exerted upon the lefthand half of the wind deflector 101. On the righthand half of the wind deflector 101, on the other hand, a clockwise force $F_r'$ is exerted within the ranges of the states $a_1$, $a_2$ and $a_3$ whereas a counter-clockwise force $F_l'$ is exerted within the range of the state $a_4$. As a result, in a state in which the wind deflecting vanes 114 in the aforementioned inner circumferential portion are in the positions of the states $b_7$ and $a_3$ so that no rotating force is exerted, the resultant force of the sum $F_R'+F_r$, in the clockwise direction is stronger than the force $F_l'$ in the counter-clockwise direction so that the wind deflector 101 is rotated clockwise at a relatively high speed (which will be referred to as a "moderately high speed"). When the wind deflecting vanes 114 are operated to invite the states $b_6$ and $a_4$, they are subjected to the force $F_l'$ for rotating the wind deflector 101 in the counter-clockwise direction. As a result, that force $F_l'$ becomes one for controlling the aforementioned clockwise rotations so that it can have its magnitude changed to interchange the speed of the wind deflector 101 to the moderate speed slower than the aforementioned moderately high speed, the slower low speed and the reverse rotations in the counter-clockwise direction. On the other hand, if the wind deflector 101 is brought to other states such as the state $b_8$ and the state $b_1$, the clockwise force $F_r'$ is exerted upon the wind deflecting vanes 114. As a result, the wind deflector 101 can be rotated at a higher speed than the moderately high speed.

Incidentally, in the second embodiment thus far described, the aforementioned operating member 118 is mounted by means of the screws 123 but may alternatively be so mounted by forming inward projections on the inner side end of the rib portion 120 of the operating member 118 and by forming the outer central frame 112 with grooves for fitting the projections therein that it is not allowed to easily come out by the engagement between the aforementioned grooves and projections, whereby its rotational range may be regulated and guided by the aforementioned grooves. Moreover, the wind deflecting vanes 114 can be reliably borne on the spindle 117 of the outer central frame 112 by means of not the bearing holes 116 but the notched grooves opened to face forward thereby to thrust the wind deflecting vanes 114 by the notches 125 of the operating member 118, whereby the wind deflecting vanes can be easily attached without any warp.

Furthermore, the first and second embodiments thus far described are directed to the structures in which either the wind deflecting vanes formed in parallel in the outer circumferential portion of the wind deflector or the wind deflecting vanes formed radially in the inner circumferential portion of the same deflector are made movable. It is, however, apparent that both of the wind deflecting vanes are made movable.

Next, the present invention will be further described in conjunction with a third embodiment thereof, which is different from the foregoing first and second embodiments, with reference to FIGS. 30 to 38.

A blower 150, as shown, is formed into a generally cubic appearance, as is different from the blowers of the foregoing embodiments, but has a substantially identical construction as those of the foregoing embodiments.

The blower 150 is composed of a synthetic resin body 151 and a rear cover 153, which is formed with a wind tunnel 152, such that the body 151 and the rear cover 153 can be longitudinally separated from each other. The body 151 is formed at its front portion with a cylindrical portion 154 which is in abutment engagement with the end portion of the wind tunnel 152. Said cylindrical portion 154 is formed at its center with a cup-shaped mounting portion 156 which is opened backward and which is formed integrally with the aforementioned body 151 by means of a plurality of plateshaped supporting ribs 155 extending in radial directions. In the states in which a motor 157 has its one half fitted in the mounting portion 156 and in which the flanged portion 158 of said motor 157 is fitted to abut against the edge of the mounting portion 156, the aforementioned motor 157 is fixed to the mounting portion 156 by screwing not-shown screws in the hub which is formed in the circumferential edge of the mounting portion 156. An axial flow fan 160 is mounted by means of a nut 161 on the shaft 159 of the aforementioned motor 157. Foldable legs 162 are attached to both the front corners of the lower face of the aforementioned body 151, and elastic heels 163 are attached to both the rear corners of the lower side of the same. The body 151 is formed at its upper portion with a space 166 for accommodating a switch 164, a timer 165 and so on for controlling the aforementioned motor 157 such that the operating portions of the switch 164 and the timer 165 are formed to protrude from the upper face of the body 151. A power supply cord 167 extending from the switch 164 and the timer 165 to the aforementioned motor 157 is arranged to extend through a groove 168 which is formed in the aforementioned supporting ribs 155. The aforementioned diverging wind tunnel 152 formed in the rear cover 153 is positioned to enclose the aforementioned axial flow fan 160. The wind tunnel 152 has its end portion so temperarily held by means of pawls 169 and 169 and engagement portions 170 and 170, which are formed on the outer side walls of the aforementioned rear cover 153 and body 151, that it abuts against the aforementioned cylindrical portion 154. The joint between the rear cover 153 and the body 151 is ensured by securing the mounting members 171 and 172, which are formed on the end portion of the wind tunnel 152, to the hubs 173 and 173, which are formed on the supporting ribs 155 at the base end side of the cylindrical portion 154, by means of screws 174 and 174. One of the aforementioned mounting members 171 is so elongated as to acts as a cover plate for plugging the aforementioned groove 168. The guard 175 is different in shape from the guard 15 of the foregoing embodiments but is formed to have the identical construction. A handle 176 is attached to the upper portion of the rear face of the rear cover 153, and there are formed on both the sides of the lower portion of the rear face of the same cord hooks 178 which are bent outward to wind thereon a power supply code 177. The handle 176 and the cord hooks 178 are made to act as legs when the blower 150 is placed on a floor while facing upward.

In the body 151, there is fitted at the front side of the cylindrical portion 154 a wind deflector 180 which is rotatably borne on a spindle 179. In the upper corner of the body 151, there is mounted a stopper mechanism 183 which is made removably engageable with an engagement portion 183 formed in the outer circumferential frame 181 of the wind deflector 180. The stopper mechanism 183 has the same construction as that of the foregoing first embodiment, although neither shown nor explained.

The aforementioned spindle 179 is made of a metal material and is so rotatably borne in a mounting plate 184 molded of a synthetic resin that it may not come out. The mounting plate 184 is fixed by means of screws 186 on a hub 185 which is formed at the back of the mounting portion 156. The mounting plate 184 is molded of an oilless synthetic resin so that the rotations of the spindle 179 may be effected without any resistane relative to said plate 184. In an alternative, a bearing may be molded and buried in the mounting plate 184 thereby to bear the spindle 179. This spindle 179 is formed at its end portion with a threaded hole 188 in which there is screwed a spinner 187 for preventing the wind deflector 180 from coming out of the spindle.

That wind deflector 180 is composed of an outer circumferential portion and a central portion. This central portion is formed at its center with a hub portion 189, through which the spindle 179 extends, and which has its rear end portion formed with such a notch 191 as is made engageable with a retaining pin 190 formed to protrude from the spindled 179. As a result, the wind deflector 180 thus constructed can rotate together with the spindle 179. The wind deflector 180 is formed at the two upper and lower thirds of its outer circumferential portion with a plurality of wind deflecting vanes 192, which are arranged in parallel with each other, and at the one middle third of its outer circumferential portion with a pair of wind deflectors 194 which are formed with a plurality of such wind deflecting vanes 193 as are arranged in parallel with the aforementioned wind deflecting vanes 192.

The wind deflector 180 is further formed at its outer circumferential frame 182 and its inner circumferential frame 195 with the bearing holes 79, the notched portions 81, the lands 86 and 87 and the lands 89 and 90. The wind deflector 194 is formed at its outer frame 106 with shorter pins, which are borne in the bearing holes 79, and longer pins 199 which are formed at their leading end portions with such bevel gears 198 as are born in the notched portions 81. The outer frame 196 is formed with the semicircular lands 91 and 92 and the elastic pawls 93 and 94 which are formed on the outer frames 75 of the wind deflectors 72 of the foregoing first embodiment and which are indicated by the identical names and at the identical reference numerals. The aforementioned central portion fits therein an annular bevel gear 200 which is in meashing engagement with the aforementioned bevel gears 198 and 198 and which is made coactive with the aforementioned wind deflectors 194 and 194. These wind deflectors 194 and 194 and the annular bevel gear 200 are attached in manners similar to those of FIGS. 16 to 18 explaining the foregoing first embodiment. On the other hand, the operations of the wind deflectors 194 and 194 are similar to those of the first embodiment.

The fixed wind deflecting vanes of the wind deflector 180 are explained in connection with the states shown in FIGS. 3 and 4. The wind deflecting vanes 192 at the lefthand half are so formed as to have their angles of inclination increased upward for the states $b_2$, $b_3$ and b4. As a result, a force $F_R''$ for rotating the wind deflector 180 in the clockwise direction is exerted upon the lefthand half. If the wind deflecting vanes 192 at the righthand half are formed to have their angles of inclination changed downward at the same rate as that of the lefthand half, a clockwise force $F_r''$ is exerted within the range of the states $a_2$ and $a_3$, but a counter-clockwise force $F_l''$ is exerted within the range of the state $a_4$. On the other hand, the wind deflector 194 is held to have its wind deflecting vanes 103 in the states $b_7$ and $a_3$ so that no force contributing to the rotations is exerted thereupon. As a result, the wind deflector 180 is rotated by the force difference between the sum of the clockwise forces $F_R''+F_r''$ and the counter-clockwise force $F_l''$ and is so set that it may rotate clockwise at a suitable rotating speed (which will be referred to as a "moderate speed" hereinafter). The aforementioned wind deflector 194 has the same motions as the wind deflector 72 which has been described in the foregoing first embodiment. When the aforementioned wind deflectors 194 and 194 are rotated to shift the state from $b_7$ to $b_1$, $b_2$, $b_3$, $b_4$ and $b_8$, the clockwise force 2 $F_R''$ is exerted so that the wind deflector 180 is accelerated to a higher speed (which will be referred to as a "high speed" hereinafter) as a result of the application of the clockwise force $2F_R''$. On the other hand, if the wind deflectors 194 and 194 are rotated to invite the state $b_6$, the counter-clockwise force $2F_L''$ is exerted. By the application of this force $2F_L''$, the rotating speed is slowed down to a lower speed (which will be referred to as a "low speed" hereinafter) until the force to obtain the aforementioned moderate speed is overlapped thereby. If the aforementioned force $2F_L''$ exceeds the force to obtain the moderate speed, the rotating speed becomes negative so that the wind deflector 180 is rotated counter-clockwise (which will be referred to as a "reverse rotation"). As has been described hereinbefore, by rotationally operating the wind deflectors 194 formed in the aforementioned wind deflector 180, the rotations of the wind deflector 180 can be changed steplessly among the high speed, the moderate speed, the low speed and the reversed rotation.

All the respective embodiments thus far disclosed to explain the present invention are directed to the axial flow fan for generating the swirling air stream, but they are not limited thereto. For example, if the wind deflector disclosed in the foregoing first embodiment is mounted on the blower having a centrifugal or tangential fan for generating a rectilinear air stream, the forces balanced between the righthand and lefthand halves thereby to cancelling each other are generated by the wind deflecting vanes, which are formed in parallel in the outer circumferential portion of said wind deflector, so that no force to rotate the wind deflector is exerted. However, a force to rotate the wind deflector in the counter-clockwise direction is exerted upon the wind deflecting vanes, which are radially formed in the inner circumferential portion of the wind deflector, so that it rotates the wind deflector in the counter-clockwise direction. If, in this state, the wind deflecting vanes at the righthand half are directed upward, the wind deflecting vanes at the lefthand are directed downward. As a result, the wind deflector is influenced by the clockwise force so that it is slowly rotated clockwise or counter-clockwise. If the wind deflector is directed in the opposite direction to the above, it is influenced by the counter-clockwise force so that it is faster rotated counter-clockwise. Incidentally, similar operational effects can be attained for the wind deflectors exemplified by the second and third embodiments. The aforementioned blowers using the centrifugal fan and the tangential fan are effective when they are used as a ventilating fan attached to a wall, an air conditioner, a ventilating fan fitted in a window, and so on. In the present invention, moreover, the body mounting the fan therein is composed of the housing members in the foregoing respective embodiments but may be constructed of a guard.

As has been described hereinbefore, the blower according to the present invention is equipped with the fan, which is operative to generate the force air stream, and the wind deflector which is formed with the multiple wind deflecting vanes and which are adapted to be rotationally driven by the wind pressure of the aforementioned air stream such that the wind deflecting vanes are at least partially made movable. By moving the movable wind deflecting vanes, the relationship in force of the wind deflector, which is established by the wind pressure, is changed to change the rotating speed of the wind deflecting plate thereby to provide another effect that the periodic changes in the wind blowing direction can be ensured for suitable uses.

What is claimed is:

1. A blower comprising:

a body housing having front and rear openings;

a fan, mounted in said body housing, for generating a wind;

a rear guard mounted on said rear opening; and wind deflector means mounted in said front opening and being freely rotatable therein, for receiving said wind and being rotated thereby, said wind deflector including:

a central portion rotatably mounted in said body housing;

an inner circumferential portion surrounding said portion including radially disposed second vanes; and outer circumferential portion, surrounding said inner circumferential portion, having first vanes disposed in parallel, wherein at least a portion of said vanes are moveable to an arbitrary angle with respect to said inner flow for changing the speed and/or direction of rotation of said wind deflector; and wherein said first vanes are plural veins formed into an integral structure, and said integral structure is rotatably borne between outer circumferential frames of said outer circumferential portion and said inner circumferential portion.

2. A blower according to Claim 1, wherein the integral structure of said first vanes comprises two structural components which are arranged symmetrically with respect to the central portion of said wind deflector and which have their shafts of rotation aligned with each other.

3. A blower according to Claim 4, wherein the two structural components formed symmetrically are adapted to rotate in opposite directions to each other so that their respective vanes can have their vane angles set at an equal value.

4. A blower acording to Claim 3, wherein said wind deflector has an annular bevel gear disposed at its central portion and made rotatable, and wherein the two structural components formed symmetrically have their respective shafts of rotation formed at their leading ends which bevel gears which are in meshing engagement with said annular bevel gear so that, by rotating one of said two structural components, the other can be rotated in the opposite direction.

5. A blower according to any of the claims 2, 3 or 4, wherein said second vanes are rotatably borne between the outer frame of said inner circumferential portion and said central portion.

6. A blower according to claim 5, wherein said second vanes are made rotatable in an identical direction so that they can have their respective vane angles set at an equal value.

7. A blower according to claim 6, wherein said wind deflector has an annular operating member disposed at its central portion and made rotatable, and wherein said annular operating member is formed with notched portions which are made engageable with the respective vanes of said second vanes so that the respective vanes of said second vanes can be rotated in an identical direction by rotationally operating said annular operating member.

8. The blower comprising:

a body housing having front and rear openings;

a fan, mounted in said body housing for generating a wind;

a rear guard mounted on said rear openings; and wind deflector means mounted in said front opening and being freely rotatable therein, for receiving said wind and being rotated thereby, comprising an inner circumferential portion and an outer circumferential portion, said outer circumferential portion having first vanes being disposed in parallel, wherein at least a portion of said first vanes are moveable to an arbitrary angle with respect to said wind for changing the speed and/or direction of said wind deflector, said first vanes being plural veins formed into an integral structure and said integral structure being rotatably borne between outer circumferential frames of said outer circumferential portion and inner circumferential portion and wherein said integral structure of said first vanes comprises two structural components which are arranged symetrically with respect to the central portion of said wind deflector and which have their shafts of rotation aligned with each other.

9. A blower according to claim 8, wherein said two symetrically formed structural components are adapted to rotate in opposite directions to each other so that their respective vanes can have their vane angle set at an equal value.

10. The blower according to claim 9, wherein said wind deflector has an annular bevel gear disposed at its central portion and made rotatable, and wherein said two structural components formed symetrically have their respective shafts of rotation formed at their leading ends with bevel gears which are in meshing engagement with said annular bevel gear so that by rotating one of said two structural components the other can be rotated in the opposite direction.

11. A blower comprising:

a body housing having front and rear openings;

a fan, mounted in said body housing, for generating a wind;

a rear guard mounted on said rear opening; and wind deflector means mounted on said front opening and being freely rotatable therein, for receiving said wind and being rotated thereby, comprising an inner circumferential portion and an outer circumferential portion, at least said outer circumferential portion having a first vane being disposed in parallel, wherein at least a portion of said vane are plural vanes formed into an integral structure, and wherein said integral structure is borne between outer circumferential frames of said outer circumferential portion and said inner circumferential portion to be movable to an arbitrary angle with respect to said wind for changing the speed and/or direction of said wind deflector.

12. The blower according to claim 11, wherein said integral structure of said first vanes comprise two structural components which are arranged symetrically with respect to said central portion of said wind deflector and which have their shaft's rotation aligned with each other.

13. The blower according to claim 12 wherein said two structural components arranged symetrically are adapted to rotate in opposite directions to each other so that their respective vanes can have their vane angles set at an equal value.

14. The blower according to claim 13, wherein said wind deflector has an annular bevel gear disposed at its central portion and made rotatable, and wherein said two structural components formed symetrically have their respective shafts of rotation formed at their leading ends with bevel gears which are in meshing engagement with said annular bevel gear so that, by rotating one of said two structural components, the other can be rotated in the opposite direction.

15. A blower comprising:

a body housing having front and rear openings;

an axial flow fan, mounted in said body housing for generating a wind;

a rear guard mounted on said rear opening; and wind deflector means mounted on said front opening and being freely rotatable therein, for receiving said wind and being rotated thereby, said wind deflector including:

a central portion rotatably mounted in said body housing;

an inner circumferential portion surrounding said central portion including radially disposed second vanes rotatably borne between an outer frame of said inner circumferential portion and said central portion, said second vanes being rotatable in identical direction so that they can have their respective vane angles set at an equal value; and an outer circumferential portion having first vanes disposed in parallel for receiving said wind and for rotating said wind deflector, at least a portion of said first vanes being movable toward an arbitrary angle with respect to said air flow for changing the speed and/or direction of said wind deflector.

16. The blower according to claim 15 wherein said wind deflector has an annular operating member disposed at its central portion and made rotatable, and where said annular operating member is formed with notched portions which are made engageable with respective vanes of said second vanes so that the respective vanes of said second vanes can be rotated in an identical direction by rotationally operating said annular operating member.

* * * * *